US007405713B2

(12) United States Patent
Koyama

(10) Patent No.: US 7,405,713 B2
(45) Date of Patent: Jul. 29, 2008

(54) LIGHT EMITTING DEVICE AND ELECTRONIC EQUIPMENT USING THE SAME

(75) Inventor: Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 651 days.

(21) Appl. No.: 11/022,550

(22) Filed: Dec. 22, 2004

(65) Prior Publication Data

US 2005/0156833 A1 Jul. 21, 2005

(30) Foreign Application Priority Data

Dec. 25, 2003 (JP) ..... 2003-429210

(51) Int. Cl.
*G09G 3/32* (2006.01)

(52) U.S. Cl. ..... 345/82; 345/36; 345/204; 345/690

(58) Field of Classification Search ..... 345/82, 345/36, 204, 690
See application file for complete search history.

(56) References Cited

U.S. PATENT DOCUMENTS

| | | | | |
|---|---|---|---|---|
| 6,091,203 | A | 7/2000 | Kawashima et al. | 315/169.3 |
| 6,362,866 | B1 | 3/2002 | Yamazaki et al. | 349/149 |
| 6,501,466 | B1 | 12/2002 | Yamagishi et al. | 345/204 |
| 6,693,616 | B2 | 2/2004 | Koyama et al. | 345/98 |
| 2003/0030382 | A1 | 2/2003 | Koyama | 315/169.1 |
| 2005/0057580 | A1* | 3/2005 | Yamano et al. | 345/690 |
| 2006/0054893 | A1* | 3/2006 | Nathan et al. | 257/72 |

FOREIGN PATENT DOCUMENTS

| | | |
|---|---|---|
| JP | 11-160734 | 6/1999 |
| JP | 11-282419 | 10/1999 |
| JP | 2001-147659 | 5/2001 |
| JP | 2001-306015 | 11/2001 |
| JP | 2003-162254 | 6/2003 |

* cited by examiner

*Primary Examiner*—Richard Hjerpe
*Assistant Examiner*—Leonid Shapiro
(74) *Attorney, Agent, or Firm*—Cook, Alex, McFarron, Manzo, Cummings & Mehler, Ltd.

(57) ABSTRACT

A pixel suitable for constant current operation of an active matrix type EL display device. The pixel comprises a first switch of which one terminal is connected to a source signal line whereas another terminal is connected to a current-voltage conversion element, a second switch of which one terminal is connected to the current-voltage conversion element whereas another terminal is connected to a voltage storage means and a voltage-current conversion element, a pixel electrode which is connected to the current-voltage conversion element and the voltage-current conversion element, and a third switch of which one terminal is connected to the pixel electrode whereas another terminal is connected to the power source line.

34 Claims, 18 Drawing Sheets

LIGHT EMITTING DEVICE AND ELECTRONIC EQUIPMENT USING THE SAME

BACKGROUND OF THE INVENTION

1. Field of the Invention

The present invention relates to a light-emitting device and more particularly to a light-emitting device using a thin film transistor formed over a transparent substrate such as glass or plastic. In addition, the invention relates to an electronic equipment using the light-emitting device.

2. Description of the Related Art

In recent years, with the advance of the communication technology, mobile phones have been widely used. In the future, transmission of moving images and a larger volume of information is expected. On the other hand, through reduction in weight of personal computers, those adapted for mobile communication have been produced. Information equipment called PDA (Personal Digital Assistant) originated in electronic notebooks has also been produced in large quantities and widely used. In addition, with the development of display devices and the like, the majority of portable information equipment are equipped with a flat panel display, and a television set using a flat panel display has been taken the place of a conventional CRT television set.

Moreover, according to recent technologies, an active matrix display device tends to be used as a display device for the above electronic equipment.

In the active matrix display device, a thin film transistor (hereafter a TFT) is arranged in each pixel and a display screen is controlled by the TFT. Compared to a passive matrix display device, such an active matrix display device has advantages in that it achieves high definition and high image quality, and it can be used for moving images. Therefore, it is expected that the mainstream of display devices for portable information equipment will shift from a passive matrix type to an active matrix type.

FIG. 12 illustrates a configuration of a pixel portion for an active matrix light-emitting device. In each pixel, a gate electrode of a switching TFT 1201 is connected to a gate signal line (G1 to Gy) for inputting selection signals from a gate signal line driver circuit. One of a source region and a drain region of the switching TFT 1201 is connected to a source signal line (S1 to Sx) for inputting signals from a source signal line driver circuit whereas the other thereof is connected to a gate electrode of a TFT 1202 for driving a light-emitting element 1204 and one electrode of a capacitor 1203. The other electrode of the capacitor 1203 is connected to a power source supply line (V1 to Vx). One of a source region and a drain region of the TFT 1202 for driving the light-emitting element 1204 is connected to the power source supply line whereas the other thereof is connected to one electrode of the light-emitting element 1204.

The light-emitting element 1204 has an anode, a cathode, and a light-emitting layer provided between the anode and the cathode. In the case where the anode of the light-emitting element 1204 is connected to the source or drain region of the TFT 1202 for driving the light-emitting element 1204, the anode corresponds to a pixel electrode whereas the cathode corresponds to a counter electrode. Instead, in the case where the cathode of the light-emitting element 1204 is connected to the source or drain region of the TFT 1202 for driving the light-emitting element 1204, the cathode corresponds to a pixel electrode whereas the anode corresponds to a counter electrode.

Note that a potential of the counter electrode is called a counter potential and a power source for providing the counter potential to the counter electrode is called a counter power source in this specification. A potential difference between the pixel electrode and the counter electrode corresponds to a drive voltage, which is applied to the light-emitting element 1204.

In such a configuration of a pixel, the amount of current flowing into a light-emitting element is easily varied depending on characteristic variations of TFTs and the characteristic variations of TFTs directly leads to display variations. Thus, a current programming method has been developed, in which a signal current is inputted to a pixel instead of a signal voltage (e.g. see Document 1).

FIG. 6 illustrates a conventional current-input type pixel using a current programming method. Description is made on FIG. 6 below. The pixel shown in FIG. 6 comprises a source signal line 601, a gate signal line 602, a power source supply line 610, switching TFTs 603 and 604, a current-voltage conversion TFT 605, a voltage-current conversion TFT 606, a storage capacitor 607, a pixel electrode 608, and a light-emitting element 609.

An operation thereof is described below. In a current programming, the gate signal line 602 is selected to turn ON the switching TFTs 603 and 604. When the switching TFTs 603 and 604 are turned ON, signal currents are supplied from the source signal line 601 through the switching TFTs 603 and 604 to charge the current-voltage conversion TFT 605, a gate terminal of the voltage-current conversion TFT 606, and the storage capacitor 607. Consequently, the current-voltage conversion TFT 605 and the voltage-current conversion TFT 606 are both turned ON, and currents flow from drain terminals to source terminals thereof. The currents flow to the light-emitting element 609 through the pixel electrode 608.

Subsequently, in a non-current programming, the gate signal line 602 is not selected to turn OFF the switching TFTs 603 and 604. Accordingly, the drain terminal of the current-voltage conversion TFT 605 is in the floating state, therefore, no current flows to the current-voltage conversion TFT 605. However, the gate terminal of the voltage-current conversion TFT 606 has the potential stored by the storage capacitor 607 and currents are kept flowing to the voltage-current conversion TFT 606. Consequently, the light-emitting element 609 keeps emitting light.

When the current-voltage conversion TFT 605 and the voltage-current conversion TFT 606 have uniform characteristics, the same amount of current flows into the respective TFTs. Therefore, display variations as is in the conventional one shown in FIG. 12 do not occur easily (see Document 2).

[Document 1]

Japanese Patent Application Laid-Open No. 2001-147659.

[Document 2]

Japanese Patent Application Laid-Open No. 2003-162254.

In such a pixel configuration, however, in a current programming, a current enough larger than a current during light emission must be supplied from source signal lines to a pixel portion. The reason is that the source signal line has large parasitic capacitance and the parasitic capacitance must be charged and discharged until a necessary potential is obtained.

Therefore, a current flows through the source signal line 601, the switching TFT 603, the current-voltage conversion TFT 605, and the light-emitting element 609 in this order in a current programming. Accordingly, the light-emitting element 609 emits light by the current during the current programming. This light emission results in the light emission that is not proper light emission after the current programming, and luminance that is not proper required luminance occurs, thus an accurate gray scale has not been achieved.

SUMMARY OF THE INVENTION

The invention provides a display device using a light-emitting element in which display variations at a display screen are suppressed and an accurate gray scale display is achieved.

According to the invention, a plurality of pixels, a plurality of source signal lines, a plurality of gate signal lines, and a plurality of power source lines are disposed in matrix, and each of the pixels comprises a first switch of which one terminal is connected to the source signal line whereas another terminal is connected to a current-voltage conversion element, a second switch of which one terminal is connected to the current-voltage conversion element whereas another terminal is connected to a storage means and a voltage-current conversion element, a pixel electrode which is connected to the current-voltage conversion element and the voltage-current conversion element, a third switch of which one terminal is connected to the pixel electrode whereas another terminal is connected to the power source line, and a light-emitting element of which one electrode corresponds to the pixel electrode.

According to the invention, a plurality of pixels, a plurality of source signal lines, a plurality of gate signal lines, and a plurality of power source lines are disposed in matrix, and each of the pixels comprises a first switch of which one terminal is connected to the source signal line whereas another terminal is connected to a drain terminal of a first thin film transistor, a second switch of which one terminal is connected to the drain terminal of the first thin film transistor whereas another terminal is connected to a gate terminal of the first thin film transistor, a storage means and a gate terminal of a second thin film transistor, a pixel electrode which is connected to a source terminal of the first thin film transistor and a source terminal of the second thin film transistor, a third switch of which one terminal is connected to the pixel electrode whereas another terminal is connected to the power source line, and a light-emitting element of which one electrode corresponds to the pixel electrode.

According to the invention, a plurality of pixels, a plurality of source signal lines, a plurality of gate signal lines, and a plurality of power source lines are disposed in matrix, and each of the pixels comprises a first switch of which one terminal is connected to the source signal line whereas another terminal is connected to drain and gate terminals of a first thin film transistor, a second switch of which one terminal is connected to the drain and gate terminals of the first thin film transistor whereas another terminal is connected to a storage means and a gate terminal of a second thin film transistor, a pixel electrode which is connected to a source terminal of the first thin film transistor and a source terminal of the second thin film transistor, a third switch of which one terminal is connected to the pixel electrode whereas another terminal is connected to the power source line, and a light-emitting element of which one electrode corresponds to the pixel electrode.

In the conventional pixel, voltage is converted into current, and the obtained amount of current is varied depending on variations in the conversion efficiency of elements even when the same amount of voltage is input. According to the invention, current is input and converted into voltage, the converted voltage is stored, and then the stored voltage is reconverted into current. A programming current does not flow to a light-emitting element but flows to a power source line through a switch in a current programming, which can resolve the conventional problem that an accurate gray scale is not achieved. In addition, a potential of the power source line can be set arbitrary and reverse voltage can be easily applied to the light-emitting element, which can delay the progress of deterioration of the light-emitting element. By providing a current-voltage conversion element and a voltage-current conversion element so as to be close to each other in a small pixel region, characteristics of the elements can be uniform and variations of conversion and reverse conversion can be suppressed. Accordingly, the accuracy of the obtained current is improved and display variations can be suppressed.

DETAILED DESCRIPTION OF THE INVENTION

Although the invention will be fully described by way of Embodiments with reference to the accompanying drawings, it is to be understood that various changes and modifications will be apparent to those skilled in the art. Therefore, unless such changes and modifications depart from the scope of the invention hereinafter defined, they should be constructed as being included therein.

Figure 1:
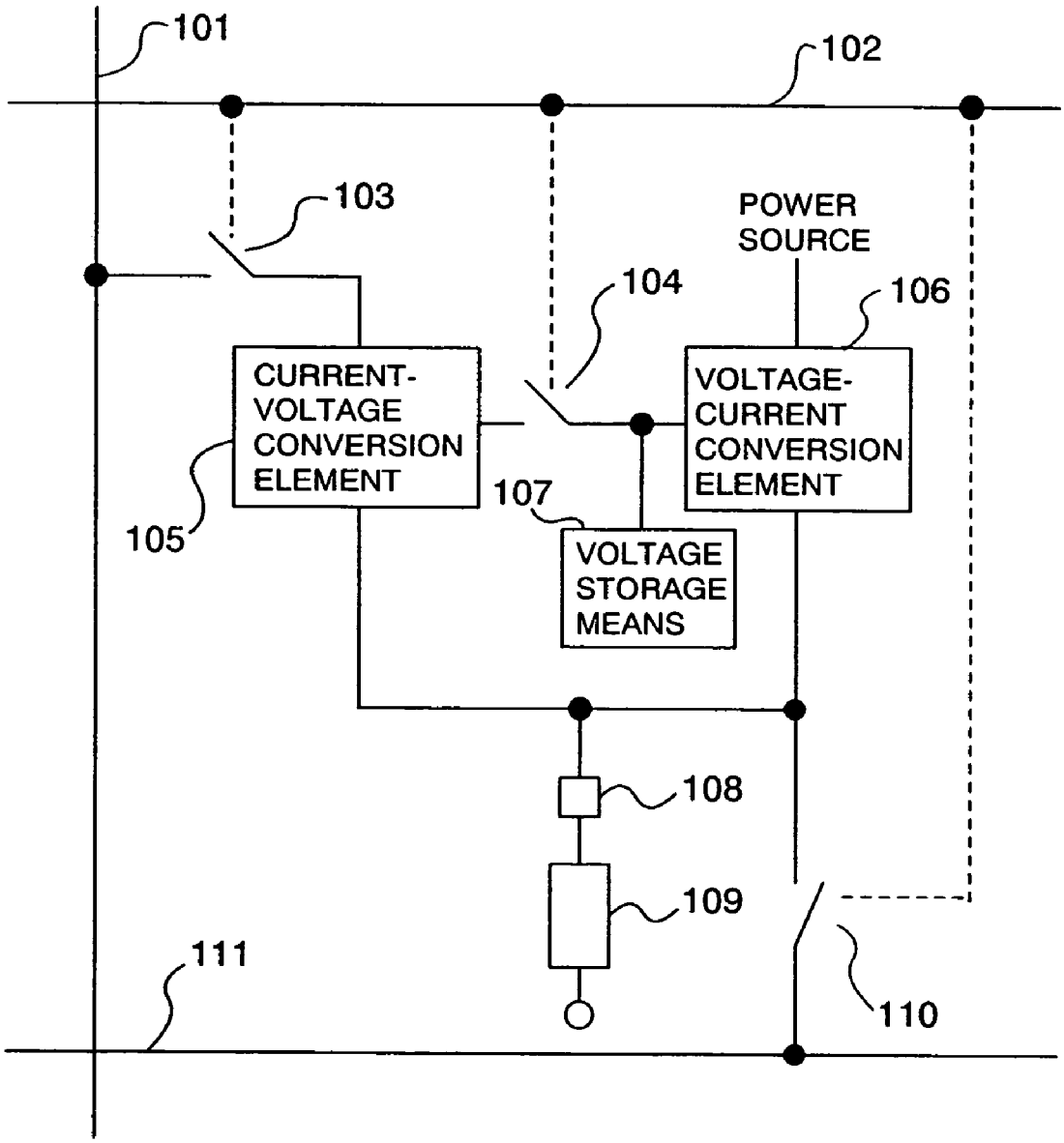
FIG. 1 is a block diagram illustrating a pixel configuration of a light-emitting device of the invention.

FIG. 1 shows a configuration of the invention. According to the invention, a pixel region includes a source signal line 101, a gate signal line 102, a first switch 103 which is controlled by the gate signal line 102 and of which one terminal is connected to the source signal line 101 whereas another terminal is connected to a current-voltage conversion element 105, a second switch 104 of which one terminal is connected to the current-voltage conversion element 105 whereas another terminal is connected to a voltage storage means 107 and a voltage-current conversion element 106, a pixel electrode 108 which is connected to the current-voltage conversion element 105 and the voltage-current conversion element 106, a light-emitting element 109 of which anode or cathode corresponds to the pixel electrode 108, a power source line 111, and a third switch 110 which is controlled by the gate signal line 102 and of which one terminal is connected to the pixel electrode 108, the current-voltage conversion element 105 and the voltage-current conversion element 106 whereas another terminal is connected to the power source line 111.

An operation thereof is described in detail below. In the case of a current programming of writing a signal to the pixel, a predetermined amount of current corresponding to a signal is input from the source signal line 101. When the gate signal line 102 is selected and the pixel is selected, the first to third switches 103, 104 and 110 are all turned ON. A current flows through the current-voltage conversion element 105, the third switch 110, and the power source line 111 in this order. Unlike the conventional light-emitting device, no signal current flows to the light-emitting element 109, so that the light-emitting element 109 does not emit light. In the current programming also, an output voltage of the current-voltage conversion element 105 is input to the voltage storage means 107 and the voltage-current conversion element 106. The voltage-current conversion element 106 is thus operated to flow a current of a power source to the power source line 111 through the third switch 110, so that no light emission occurs. At this time, by setting a potential of the power source line 111 so as not to turn ON the light-emitting element 109, a reverse voltage can be easily applied to the light-emitting element 109, which can delay the progress of deterioration of the light-emitting element 109.

When the current programming is terminated, the gate signal line 102 is not selected to turn OFF the first to third switches 103, 104 and 110. Accordingly, a signal current stops flowing to the pixel from the source signal line 101. Although the current-voltage conversion element 105 is supplied with no current, the voltage-current conversion element 106 keeps ON state due to the voltage stored in the voltage storage means 107. Consequently, a current of the power source flows into the light-emitting element 109 through the pixel electrode 108, so that light emission occurs during a period in which the voltage-current conversion element 106 is ON. This operation continues until the start of the subsequent current programming.

The current flowing into the light-emitting element 109 is controlled by the amount of input current of the source signal line 101 here. The current-voltage conversion element 105 and the voltage-current conversion element 106 can be set to have a proportional relationship between respective flowing currents. When the two elements have the uniform characteristics, the substantially constant amount of current can be supplied to the light-emitting element even when element characteristics differ between pixels. For example, even in the case where a gate insulating film has some variations over a large substrate, the difference between close-in gate insulating films is small within a pixel, that is, the difference within one pixel is small. Therefore, the amount of current which is almost accurately corresponding to the current flowing from the source signal line 101, can be made to flow to the light-emitting element 109. In this manner, uniformity which has been a problem in the prior art can be improved, and good uniformity at a display screen can be obtained. In addition, such a problem that an accurate gray scale display is not achieved can be resolved.

The light-emitting element herein includes both of an element that utilizes luminescence generated when an excited singlet state returns to a base state (fluorescence) and an element that utilizes luminescence generated when an excited triplet state returns to a base state (phosphorescence). Although an electroluminescence element is employed as the light-emitting element in this specification, other light-emitting elements can be employed as well.

A light-emitting element generally has such a laminated structure that an organic layer is sandwiched between a pair of electrodes (a cathode and an anode). In addition to this, there are such laminated structures that a hole injection layer, a hole transporting layer, a light-emitting layer, and an electron transporting layer are laminated in this order, and that a hole injection layer, a hole transporting layer, a light-emitting layer, an electron transporting layer, and an electron injection layer are laminated in this order. The invention can adopt any one of these structures and fluorescent pigment may be doped into the light-emitting layer. Note that in this specification, all layers sandwiched between the anode and the cathode are collectively called the organic electroluminescent layer. Therefore, the hole injection layer, the hole transporting layer, the light-emitting layer, the electron transporting layer, and the electron injection layer are all included in the electroluminescent layer.

Embodiment 1

Figure 2:
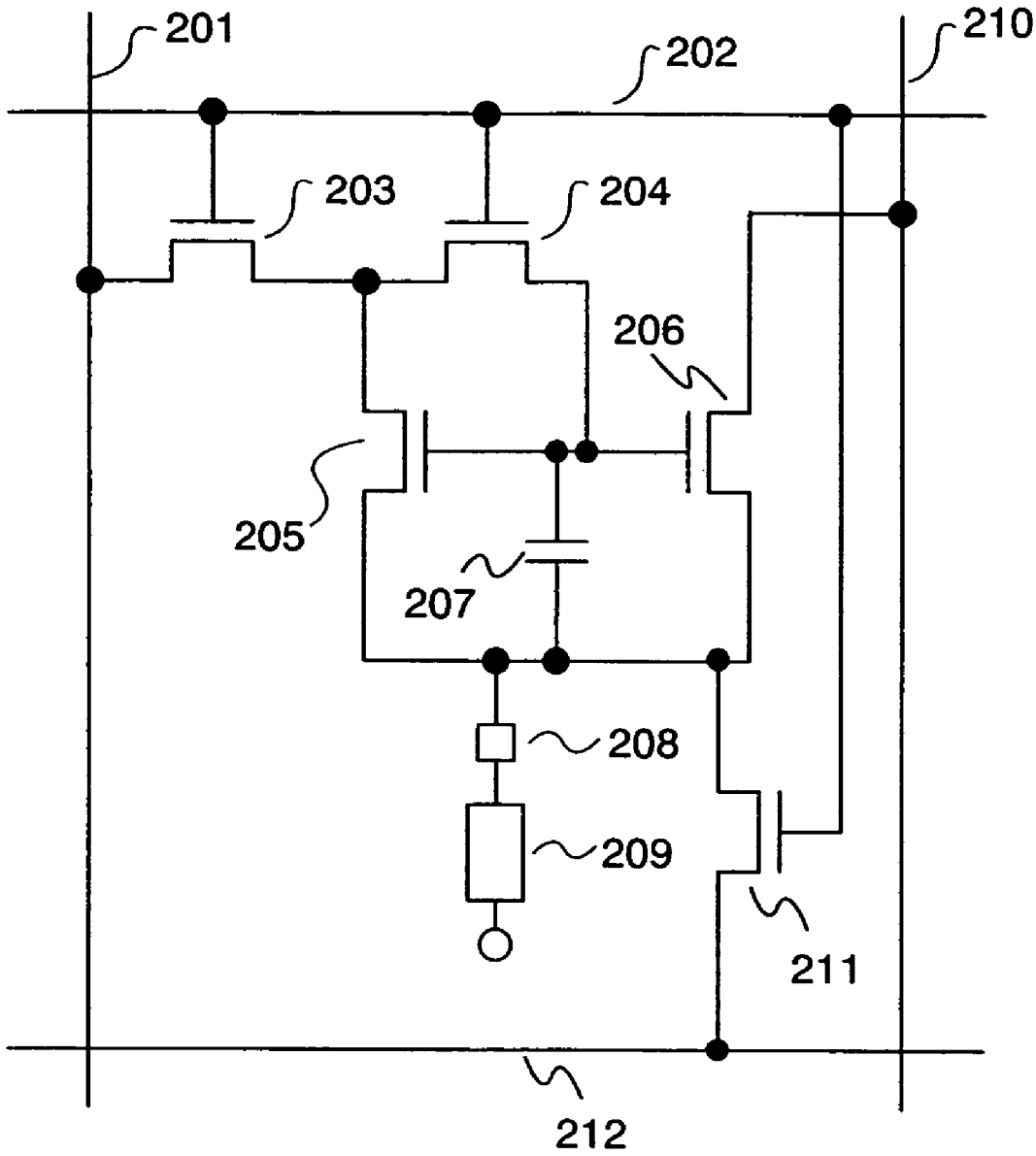
FIG. 2 is a diagram illustrating a circuit configuration of a pixel of a light-emitting device of the invention.

FIG. 2 illustrates one embodiment of the invention in which a pixel region is configured by TFTs. In this embodiment, a current-voltage conversion element, a voltage-current conversion element, and first to third switches are each formed by a TFT while a storage means is formed by a thin film capacitor.

According to this embodiment, a pixel region includes a source signal line 201, a gate signal line 202, a first switching TFT 203 which is controlled by the gate signal line 202 and of which one terminal is connected to the source signal line 201 whereas another terminal is connected to a drain terminal of a TFT 205, a second switching TFT 204 of which one terminal is connected to the drain terminal of the TFT 205 whereas another terminal is connected to a gate terminal of the TFT 205, a voltage storage capacitor 207 and a gate terminal of a TFT 206, a pixel electrode 208 which is connected to a source terminal of the TFT 205 and a source terminal of the TFT 206, a light-emitting element 209 of which anode or cathode corresponds to the pixel electrode 208, a third switching TFT 211 of which one terminal is connected to the source terminals of the TFTs 205 and 206 whereas another terminal is connected to a power source line 212.

An operation thereof is described in detail below. In the case of a current programming of writing a signal to the pixel, a predetermined amount of signal current is input from the source signal line 201. When the pixel is selected, the gate signal line 202 is selected to turn ON the first and second switching TFTs 203 and 204. The signal current flows through the TFT 205, the third switching TFT 211, and the power source line 212 in this order. In the current programming also, a gate voltage of the TFT 205 is input to the voltage storage capacitor 207 and the gate terminal of the TFT 206 through the second switching TFT 204. The TFT 206 is thus operated to flow a current of a power source line 210 to the power source line 212 through the third switching TFT 211. At this time, by setting a potential of the power source line 212 so as not to turn ON the light-emitting element 209, all the current flows to the power source line 212, so that the light-emitting element 209 does not emit light. By setting the potential arbitrarily, a reverse voltage can be easily applied to the light-emitting element 209, which can delay the progress of deterioration of the light-emitting element 209.

When the current programming is terminated, the gate signal line 202 is not selected to turn OFF the first and second switching TFTs 203 and 204. Accordingly, a current stops flowing to the pixel from the source signal line 201. Although the TFT 205 is supplied with no current, the TFT 206 keeps ON state due to the voltage stored in the voltage storage capacitor 207. The third switching TFT 211 is turned OFF and no current flows through it. Consequently, a current of the power source flows into the light-emitting element 209 through the pixel electrode 208, so that light emission occurs during a period in which the TFT 206 is ON. This operation continues until the start of the subsequent current programming.

According to this embodiment, in the current programming, a signal current flows to the power source line 212 through the switching TFTs, so that no light emission occurs. Therefore, the light-emitting element 209 serves only for an accurate light emission, so that an accurate gray scale can be achieved.

Here, the current flowing into the light-emitting element 209 is controlled by the amount of input current of the source signal line 201. The TFT 205 and the TFT 206 can be set to have a proportional relationship between respective flowing currents. That is, the respective gate widths are preferably set at an arbitrary ratio or a different width to set a flowing current ratio between the TFT 205 and the TFT 206. When the two elements have the uniform characteristics, the substantially constant amount of current can be supplied to the light-emitting element even when element characteristics differ between pixels. For example, even in the case where a gate insulating film has some variations over a large substrate, the difference between close-in gate insulating films is small within a pixel, that is, the difference within one pixel is small. Therefore, the amount of current which is almost accurately corresponding to the current flowing from the source signal line 201 can be made to flow to the light-emitting element 209. In this manner, uniformity which has been a problem in the prior art can be improved, and good uniformity at a display screen can be obtained. In addition, such the problem that an accurate gray scale display is not achieved can be resolved.

The invention is particularly effective in the case of adopting a unipolar process which especially uses N-type (N-channel) TFTs. An N-type (N-channel) TFT has higher mobility than a P-type (P-channel) TFT, and thus is advantageous in forming a circuit. Note that in the case of an amorphous TFT or a semi-amorphous TFT, only an N-type (N-channel) TFT can be employed. Furthermore, in forming a light-emitting element, it can be formed easier with an anode used as a pixel electrode connected to the TFT as compared to with a cathode used as the pixel electrode. In the case where the pixel electrode corresponds to the anode, it is necessary that a current flows from the TFT. In a current-input type display device disclosed in Japanese Patent Application Laid-Open No. 2001-147659, a P-type TFT drives a pixel electrode, and thus a P-type TFT has to be used also for a driver circuit when manufacturing a unipolar display device, that is disadvantageous for operation. On the other hand, in a current-input type display device disclosed in Japanese Patent Application Laid-Open No. 11-282419, although an N-type TFT is used, a light-emitting element is connected to a drain region of the TFT. Thus, a pixel electrode has to be used as a cathode, which makes difficult to form the light-emitting element. According to the invention, an N-type TFT is used, and a pixel electrode can be used as an anode. Therefore, in manufacturing a unipolar panel, there is an advantage that driver operation and easy formation of a light-emitting element are simultaneously satisfied.

Embodiment 2

Figure 3:
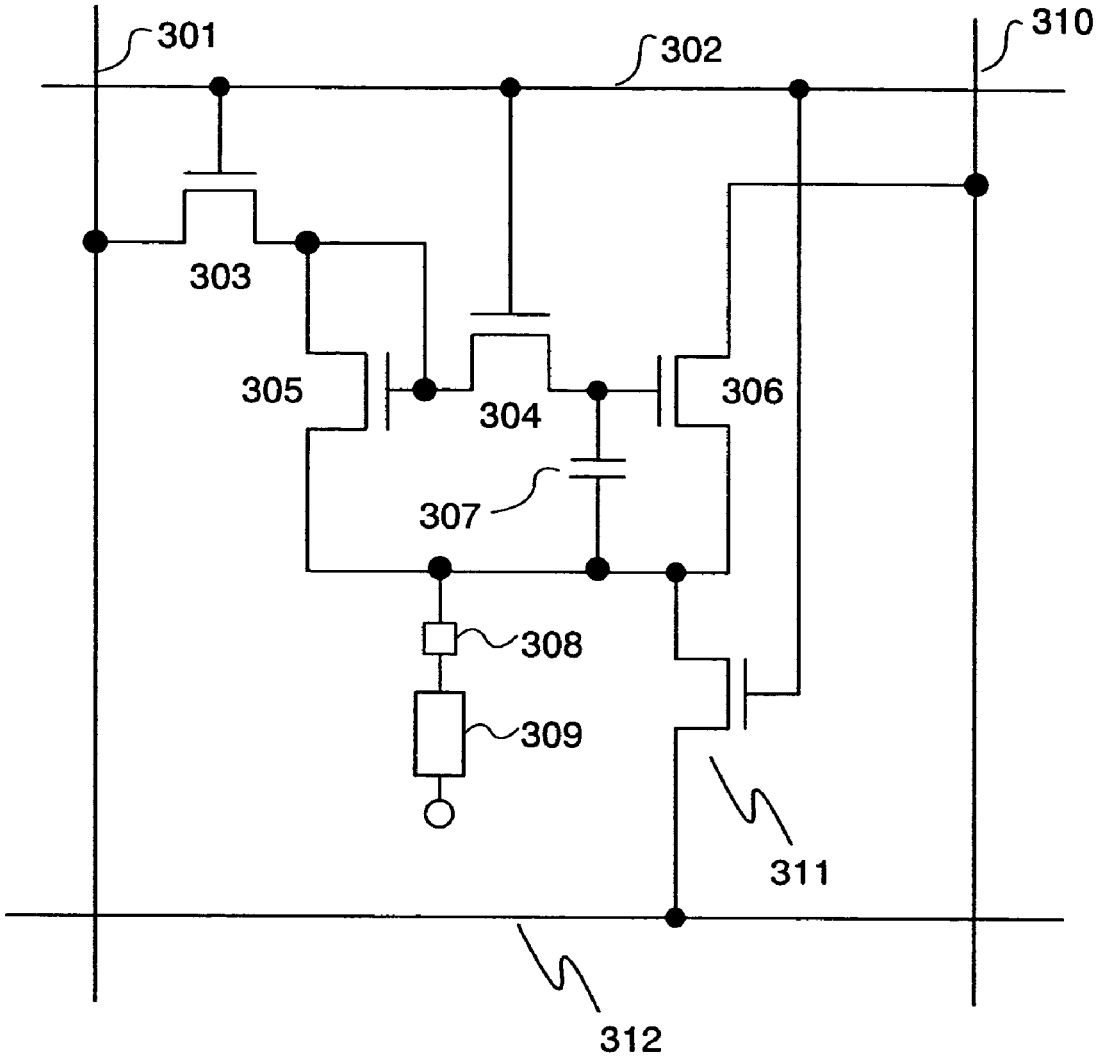
FIG. 3 is a diagram illustrating a circuit configuration of a pixel of a light-emitting device of the invention.

FIG. 3 shows the pixel described in Embodiment 1, in which the switch connection is changed.

According to this embodiment, a pixel region includes a source signal line 301, a gate signal line 302, a first switching TFT 303 which is controlled by the gate signal line 302 and of which one terminal is connected to the source signal line 301 whereas another terminal is connected to drain and gate terminals of a TFT 305, a second switching TFT 304 of which one terminal is connected to the drain and gate terminals of the TFT 305 whereas another terminal is connected to a voltage storage capacitor 307 and a gate terminal of a TFT 306, a pixel electrode 308 which is connected to a source terminal of the TFT 305 and a source terminal of the TFT 306, and a light-emitting element 309 of which anode or cathode corresponds to the pixel electrode 308.

An operation thereof is described in detail below. In a current programming of writing a signal to the pixel, a predetermined amount of signal current is input from the source signal line 301. When the pixel is selected, the first to third switching TFTs 303, 304 and 311 are turned ON. The signal current flows through the first switching TFT 303, the TFT 305, the third switching TFT 311, and a power source line 312 in this order. In the current programming also, a gate voltage of the TFT 305 is input to the voltage storage capacitor 307 and the gate terminal of the TFT 306 through the second switching TFT 304. The TFT 306 is thus operated to flow a current of a power source line 310 to the power source line 312 through the TFT 306 and the third switching TFT 311. At this time, by setting a potential of the power source line 312 so as not to turn ON the light-emitting element 309, all the current flows to the power source line 312, so that the light-emitting element 309 does not emit light.

When the current programming is terminated, the first to third switching TFTs 303, 304 and 311 are turned OFF and a current stops flowing to the pixel from the source signal line 301. Although the TFT 305 is turned OFF, the TFT 306 keeps ON state due to the voltage stored in the voltage storage capacitor 307. Consequently, a current of the power source flows into the light-emitting element 309 through the pixel electrode 308, so that light emission occurs during a period in which the TFT 306 is ON. This operation continues until the start of the subsequent current programming.

According to this embodiment, in the current programming, a signal current flows to the power source line 312 through the switching TFTs, so that no light emission occurs. Therefore, the light-emitting element 309 serves only for an accurate light emission, and an accurate gray scale can be achieved.

Embodiment 3

Figure 4:
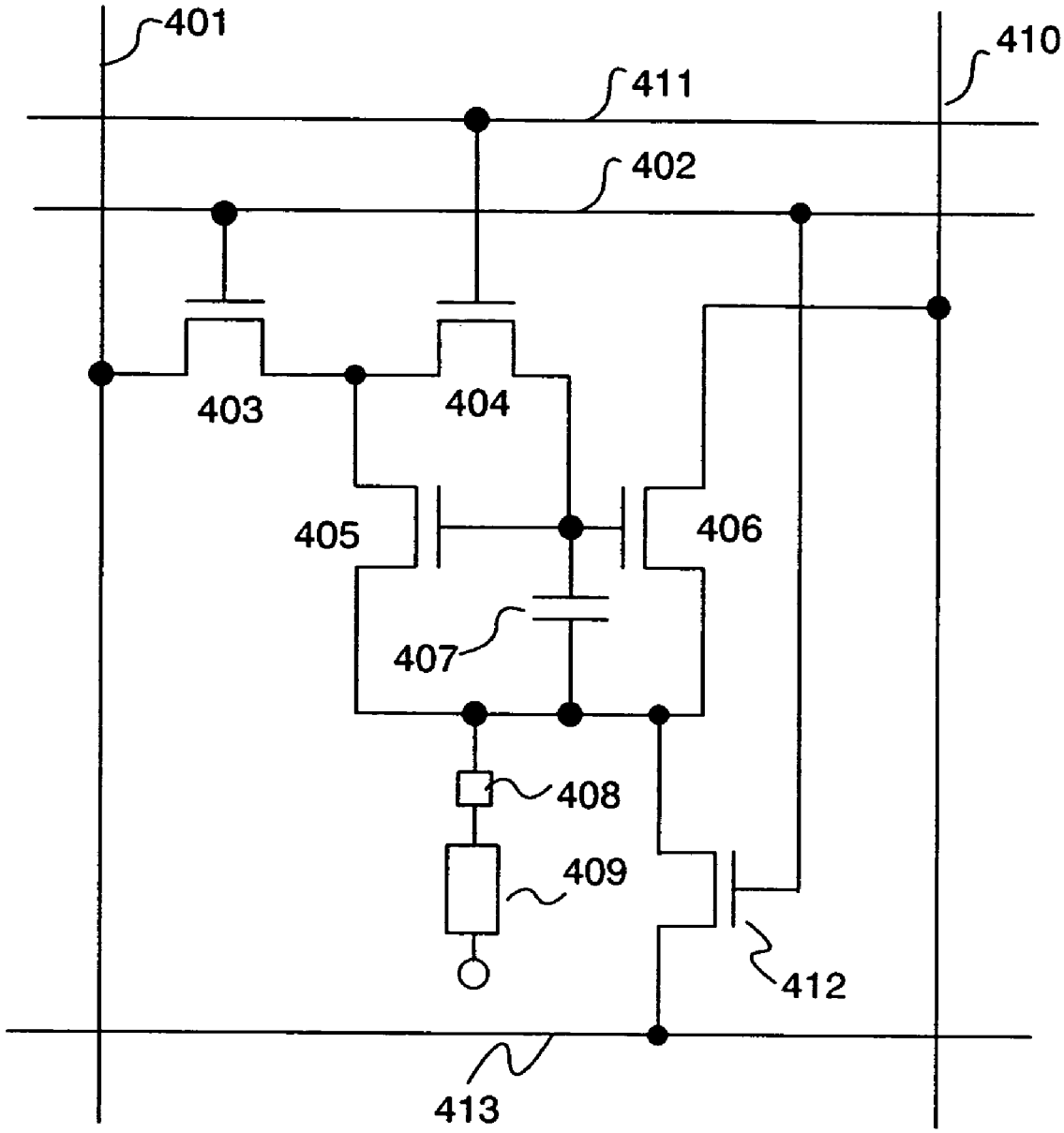
FIG. 4 is a diagram illustrating a circuit configuration of a pixel of a light-emitting device of the invention.

In FIG. 4, a first switching TFT 403 and a second switching TFT 404 are controlled by two different gate signal lines. By using the two gate signal lines, respective timing of on/off can be staggered between the switches to further improve controllability. Although a gate terminal of a third switching TFT 403 is connected to a gate signal line 402 here, it may be connected to a gate signal line 411 or a wiring which is additionally provided.

According to this embodiment, a pixel region includes a source signal line 401, a gate signal line 402, a first switching TFT 403 which is controlled by the gate signal line 402 and of which one terminal is connected to the source signal line 401 whereas another terminal is connected to a drain terminal of a TFT 405, a second switching TFT 404 of which one terminal is connected to the drain terminal of the TFT 405 whereas another terminal is connected to a gate terminal of the TFT 405 and a voltage storage capacitor 407 and a gate terminal of a TFT 406, a pixel electrode 408 which is connected to a source terminal of the TFT 405 and a source terminal of the TFT 406, a light-emitting element 409 of which anode or cathode corresponds to the pixel electrode 408, a third switching TFT 412 of which one terminal is connected to the source terminals of the TFTs 405 and 406 whereas another terminal is connected to a power source line 413.

An operation thereof is described in detail below. In a current programming of writing a signal to the pixel, a predetermined amount of signal current is input from the source signal line 401. When the pixel is selected, the gate signal lines 402 and 411 are selected to turn ON the first and second switching TFTs 403 and 404. The signal current flows through the TFT 405, the third switching TFT 412, and a power source line 413 in this order. In the current programming also, a gate voltage of the TFT 405 is input to the voltage storage capacitor 407 and the gate terminal of the TFT 406 through the second switching TFT 404. The TFT 406 is thus operated to flow a current of a power source line 410 to the power source line 413 through the TFT 406 and the third switching TFT 412. At this time, by setting a potential of the power source line 413 so as not to turn ON the light-emitting element 409, all the current flows to the power source line 413, so that the light-emitting element 409 does not emit light.

When the current programming is terminated, the gate signal lines 402 and 411 are not selected to turn OFF the first and second switching TFTs 403 and 404, and a current stops flowing to the pixel from the source signal line 401. Although the TFT 405 is supplied with no current, the TFT 406 keeps ON state due to the voltage stored in the voltage storage capacitor 407. The third switching TFT 412 is also turned OFF, therefore, no current flows into the third switching TFT 412. Consequently, a current of a power source flows into the light-emitting element 409 through the pixel electrode 408, so that light emission occurs during a period in which the TFT 406 is ON. This operation continues until the start of the subsequent current programming.

According to this embodiment, in the current programming, a signal current flows to the power source line 413 through the switching TFTs, so that no light emission occurs. Therefore, the light-emitting element 409 serves only for an accurate light emission, and an accurate gray scale can be achieved.

The switch connection described in Embodiment 2 may also be employed.

Embodiment 4

Figure 5:
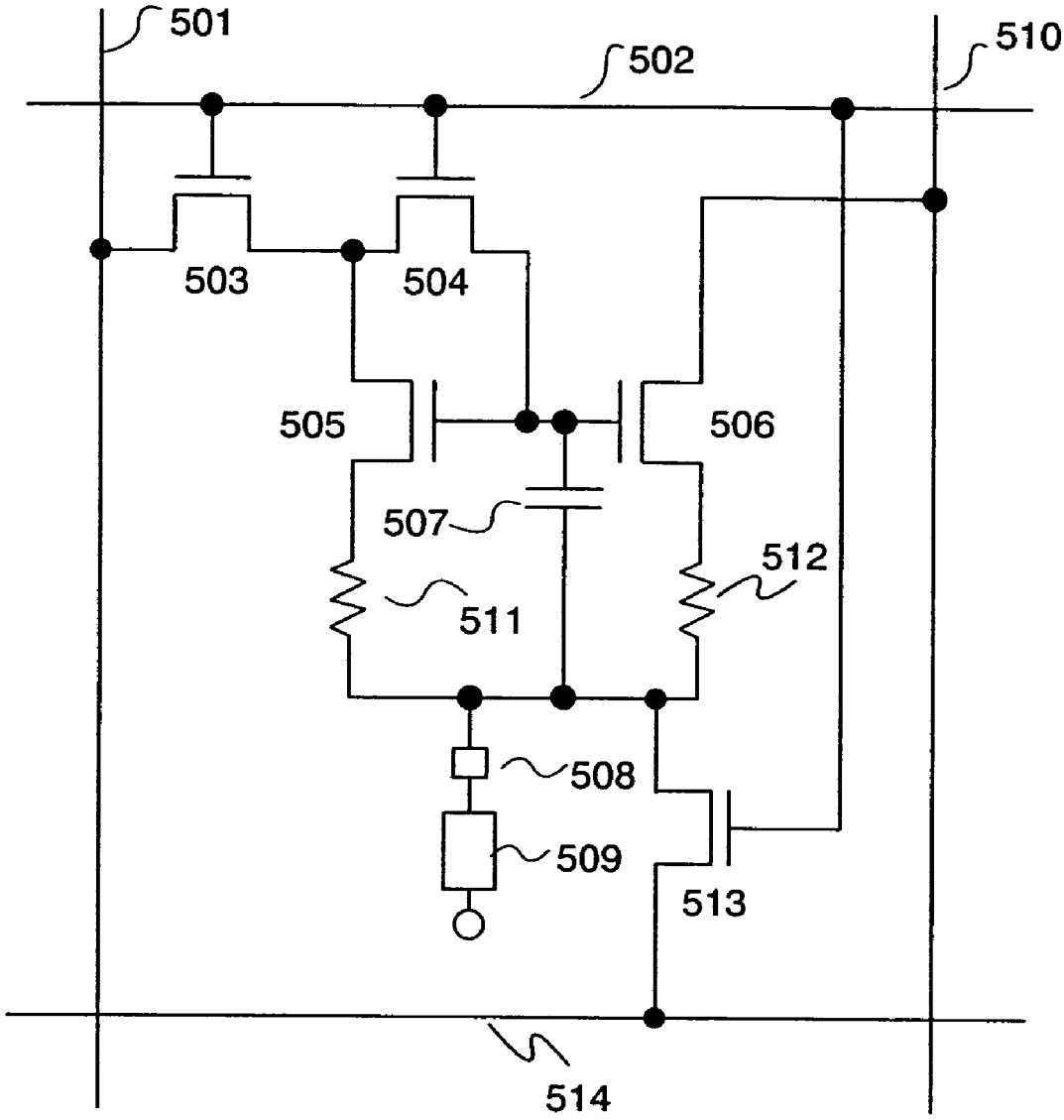
FIG. 5 is a diagram illustrating a circuit configuration of a pixel of a light-emitting device of the invention.
Figure 6:
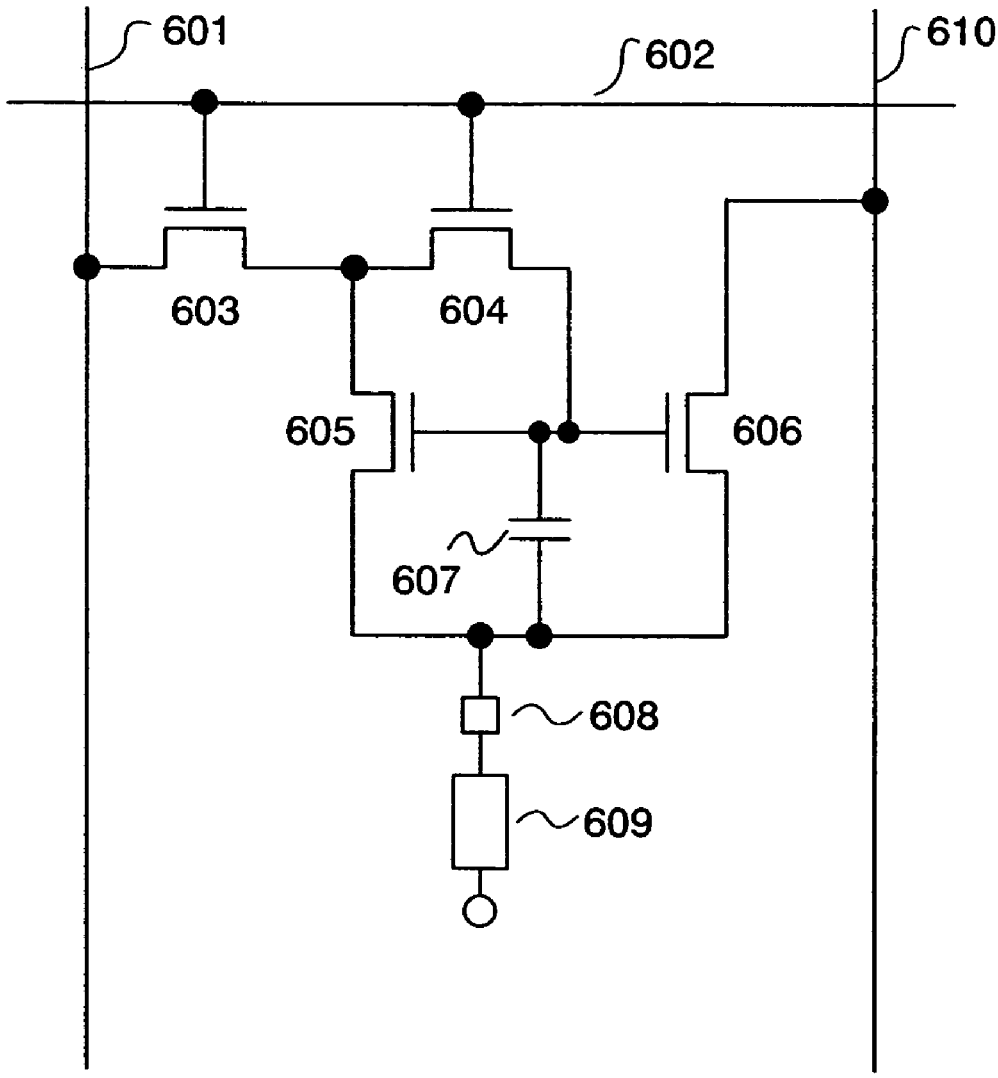
FIG. 6 is a diagram illustrating a circuit configuration of a pixel of a conventional light-emitting device.

In FIG. 5, a resistor is provided between a source electrode of a TFT 505 and a pixel electrode and between a source electrode of a TFT 506 and the pixel electrode. By providing the resistors in this manner, relative current ratio in the TFTs 505 and 506 can be improved.

According to this embodiment, a pixel region includes a source signal line 501, a gate signal line 502, a first switching TFT 503 which is controlled by the gate signal line 502 and of which one terminal is connected to the source signal line 501 whereas another terminal is connected to a drain terminal of the TFT 505, a second switching TFT 504 of which one terminal is connected to the drain terminal of the TFT 505 whereas another terminal is connected to a gate terminal of the TFT 505, a voltage storage capacitor 507 and a gate terminal of the TFT 506, a resistor 511 which is connected to a source terminal of the TFT 505, a resistor 512 which is connected to a source terminal of the TFT 506, a pixel electrode 508, a light-emitting element 509 of which anode or cathode corresponds to the pixel electrode 508, and a third switching TFT 513 of which one terminal is connected to the source terminals of the TFTs 505 and 506 whereas another terminal is connected to a power source line 514.

An operation thereof is described in detail below. In a current programming of writing a signal to the pixel, a predetermined amount of signal current is input from the source signal line 501. When the pixel is selected, the gate signal line 502 is selected to turn ON the first and second switching TFTs 503 and 504. The signal current flows through the TFT 505, the resistor 511, the third switching TFT 513, and the power source line 513 in this order. In the current programming also, a gate voltage of the TFT 505 is input to the voltage storage capacitor 507 and the gate terminal of the TFT 506 through the second switching TFT 504. The TFT 506 is thus operated to flow a current of a power source line 510 to the power source line 514 through the TFT 1506, the resistor 512 and the third switching TFT 513. At this time, by setting a potential of the power source line 514 so as not to turn ON the light-emitting element 509, all the current flows to the power source line 514, so that the light-emitting element 509 does not emit light.

When the current programming is terminated, the gate signal line 502 is not selected to turn OFF the first and second switching TFTs 503 and 504, and a current stops flowing to the pixel from the source signal line 501. Although the TFT 505 is supplied with no current, the TFT 506 keeps ON state due to the voltage stored in the voltage storage capacitor 507. The third switching TFT 513 is also turned OFF, therefore, no current flows into the third switching TFT 513. Consequently, a current of the power source line 510 flows into the light-emitting element 509 through the pixel electrode 508, so that light emission occurs during a period in which the TFT 506 is ON. This operation continues until the start of the subsequent current programming.

According to this embodiment, in the current programming, a signal current flows to the power source line 514 through the switching TFTs, so that no light emission occurs. Therefore, the light-emitting element 509 serves only for an accurate light emission, and an accurate gray scale can be achieved.

Note that this embodiment may be implemented in combination with the switch connection described in Embodiment 2 or the switch controlling method by two gate signal lines described in Embodiment 3.

Embodiment 5

Figure 7:
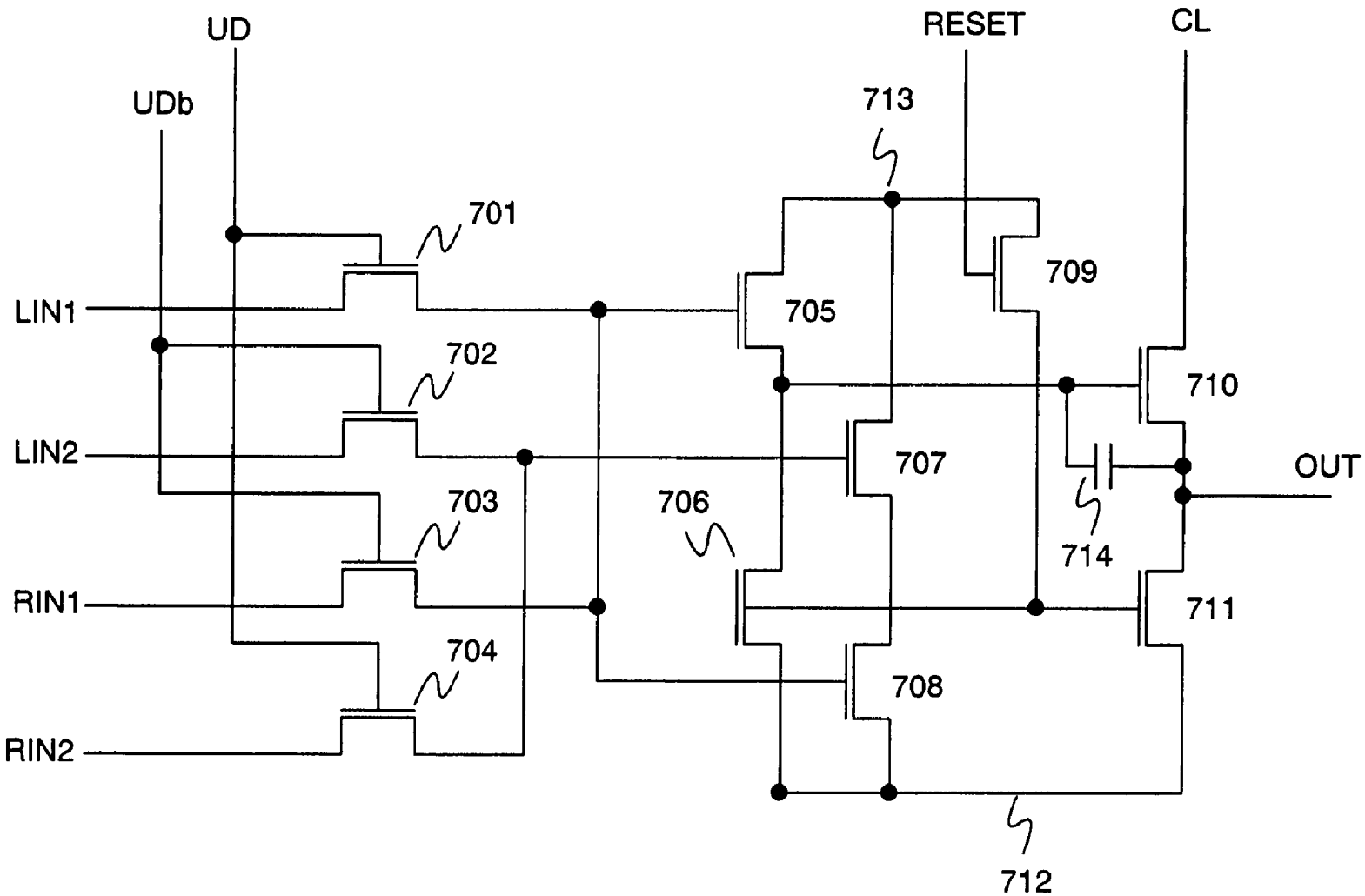
FIG. 7 is a circuit diagram of a unipolar shift register circuit.

FIG. 7 shows an embodiment of a shift resistor configured by a unipolar transistor. In a circuit configured by a unipolar transistor, a bootstrap circuit is employed to increase an output potential in many cases. This embodiment employs the bootstrap circuit.

The case of using an N-type transistor is described herein. In the case of using a P-type TFT, the signals are inverted though its basic operation is not changed. FIG. 7 illustrates a circuit for one stage of the shift resistor. Reference symbols UD and UDb each denotes a signal for changing an operation direction, by which TFTs 701 to 704 are operated, and a signal to be input to a main part of the shift resistor is selected by LIN1, LIN2, RIN1, and RIN2.

The main part of the shift resistor is configured by TFTs 705 to 708, 710, and 711, and a shifted output is output to an output terminal OUT. Reference symbol RESET denotes a signal for an initial setting that is carried out by means of a TFT 709. When the OUT becomes Hi in the shift resistor, charges accumulated in a capacitor 714 are stored because of no discharge path. That is, a potential at the output terminal OUT is increased to Hi, namely a power source potential, without varying a gate-source voltage of the TFT 710. A gate potential of the TFT 710 becomes higher than a high potential power source 713. A reference numeral 712 denotes a power source line.

Pulses can be shifted sequentially in this manner, which can be carried out using the technology disclosed in Japanese Patent Application Laid-Open No. 2001-306015.

Figure 8:
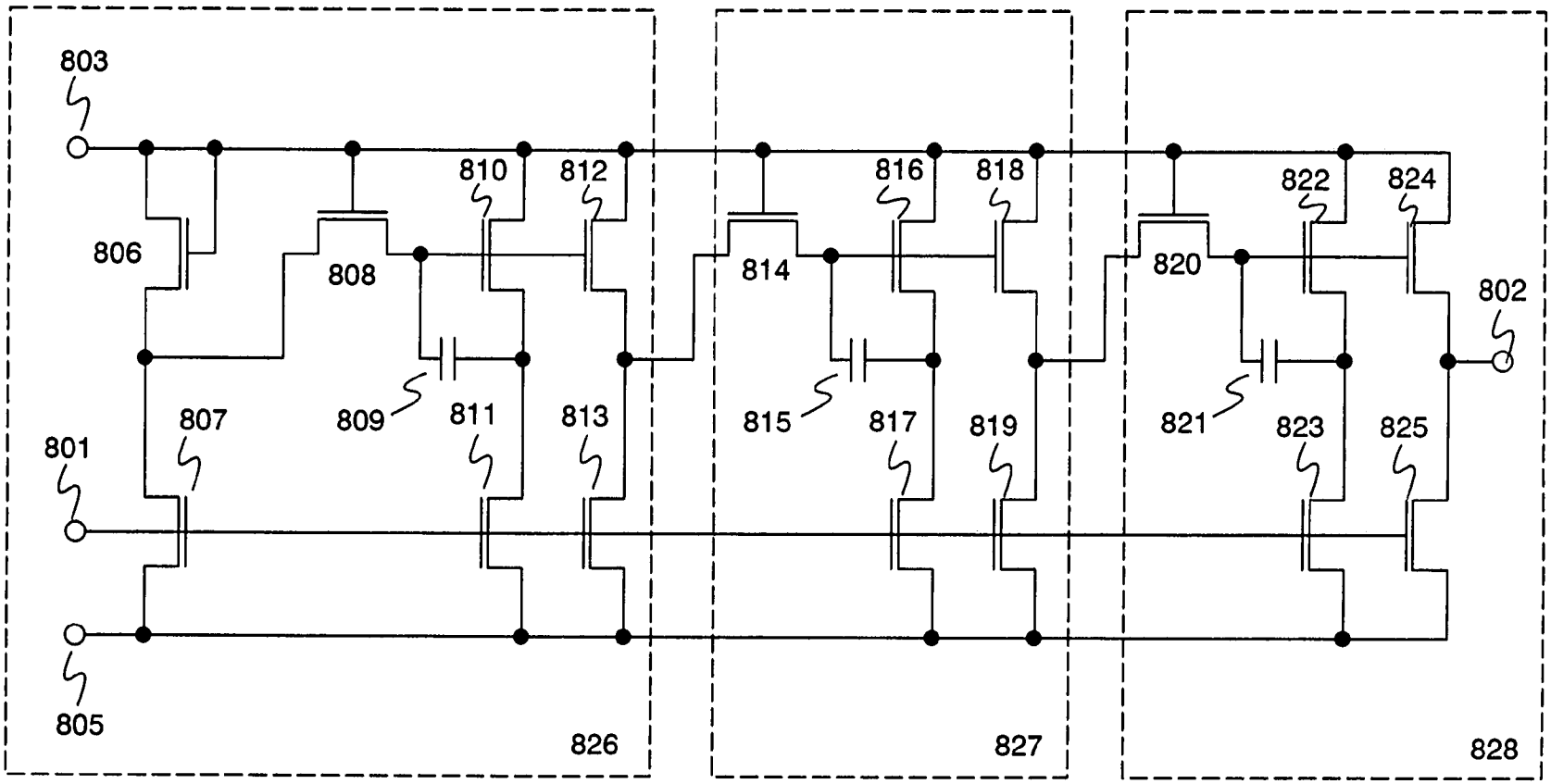
FIG. 8 is a circuit diagram of a unipolar buffer circuit.

FIG. 8 shows a buffer circuit portion of a unipolar signal line driver circuit, which serves to buffer a signal from the shift resistor and drive a gate signal line. The buffer circuit shown in FIG. 8 is structured by three stages (a buffer circuit 826 at the first stage, a buffer circuit 827 at the second stage, and a buffer circuit 828 at the third stage). The buffer circuit 826 at the first stage is configured by an inverter (including TFTs 806 and 807) for inverting a signal input from an input terminal 801, a bootstrap circuit including TFTs 808, 810, and 811 and a capacitor 809, and TFTs 812 and 813 for operating the buffer circuit 827 at the second stage. The buffer circuit 827 at the second stage is configured by a bootstrap circuit including TFTs 814, 816, and 817 and a capacitor 815, and TFTs 818 and 819 for operating the buffer circuit 828 at the third stage. The buffer circuit 828 at the third stage is configured by a bootstrap circuit including TFTs 820, 822, and 823 and a capacitor 821, and TFTs 824 and 825 for operating an output terminal 802. The buffer circuits 826 to 828 at the first to third stages are connected to the same power source potential 803. A reference numeral 805 denotes a power source line.

By connecting such a circuit portion to an output of the shift register, a gate signal line can be driven. When the buffer circuit is configured by a unipolar transistor, a pixel portion and a signal line driver circuit portion can be configured by the same type transistor. Accordingly, a manufacturing step can be simplified and the cost reduction is achieved.

Embodiment 6

Figure 9:
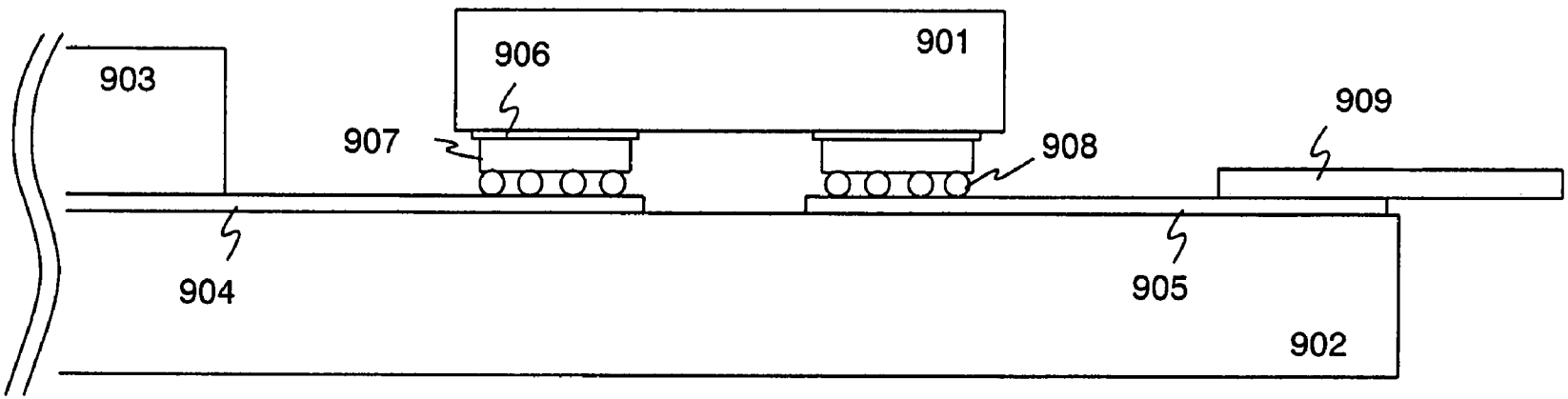
FIG. 9 is a diagram illustrating a mounting of a driver circuit of a light-emitting device of the invention.

FIG. 9 shows an embodiment of mounting an IC onto a light-emitting device of the invention. In FIG. 9, the periphery of the IC is magnified. The IC may be a chip obtained by cutting a single-crystalline silicon wafer, or may be a stick-shaped thin film transistor formed over a glass.

Shown in FIG. 9 are an IC 901, a TFT substrate 902 of a light-emitting device, a counter substrate 903 of the light-emitting device, a circuit wiring 904, a leading wiring 905, an IC electrode 906, a bump 907, a conductive particle 908, and an FPC (Flexible Print Circuit) 909. The circuit wiring 904 which is connected to a display portion and the leading wiring 905 for the FPC 909 are formed over the TFT substrate 902, and the IC 901 provided with the IC electrode 906 and the bump 907 is mounted thereover.

The circuit wiring 904 and the leading wiring 905 are connected to the IC 901 through the conductive particle 908. The conductive particle 908 has the conductivity when heat and pressure are applied.

First, anisotropic conductive paste containing the conductive particle 908 is applied to the peripherally of the wirings over the TFT substrate 902. Then, the IC 901 provided with the bump 907 is disposed at the position for the connection. Subsequently, pressure and heat are applied between the TFT substrate 902 and the IC 901. The bump 907 is formed over the IC electrode 906, which makes a difference in height from a portion provided with no electrode. Therefore, pressure is not applied to conductive particles in the area without the bump 907. Accordingly, the conductive particle 908 in the area without the bump 907 has not conductivity but insulativity.

In this manner, only the conductive particle to which heat and pressure is applied has conductivity, which leads to conductivity between the circuit wiring 904 and the bump 907, and between the leading wiring 905 and the bump 907. Such a mounting method using the conductive particle can be carried out at a temperature of about 120° C., and thus heat treatment at 200° C. or more as is in the case of using a solder is not required. Therefore, even in the case where a TFT substrate or an IC is formed by a material or an element which is weak against heat, mounting can be achieved.

In this embodiment, a mounting method using a conductive particle is described, however, a mounting method of the invention is not limited to this.

Embodiment 7

Figure 10A:
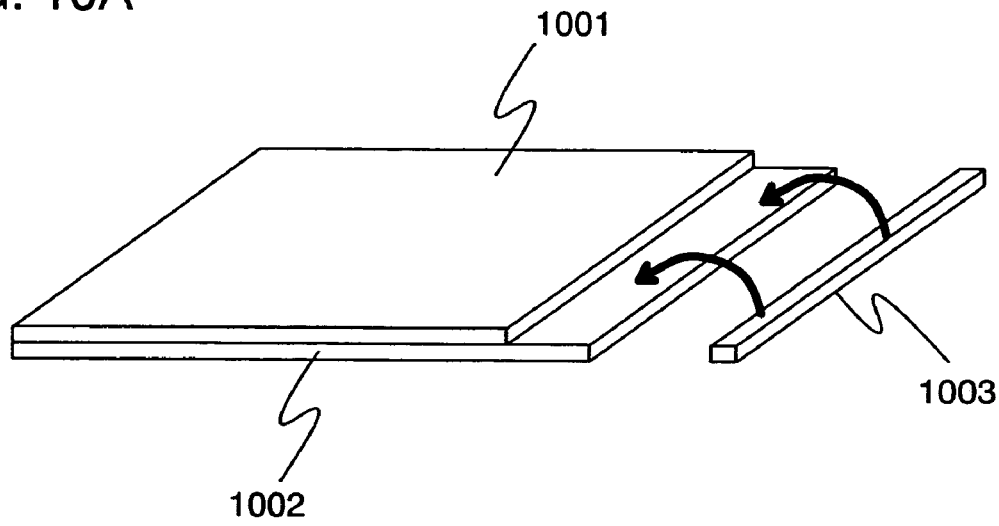
FIGS. 10A and 10B are diagrams each illustrating a mounting of a driver circuit of a light-emitting device of the invention.
Figure 10B:
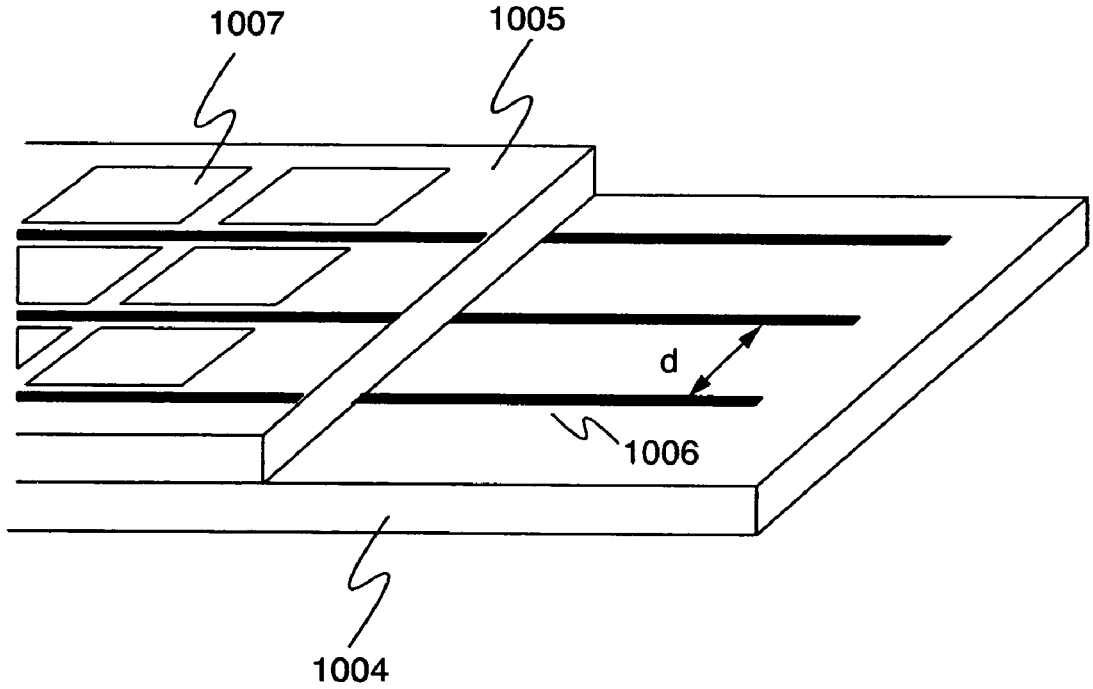

FIGS. 10A and 10B illustrate a mounting of a stick-shaped IC onto a light-emitting device of the invention. In the stick-shaped IC, a TFT is not formed over a single-crystalline silicon wafer but formed over a glass substrate, as is disclosed in Japanese Patent Application Laid-Open No. 11-160734.

A stick-shaped IC 1003 is mounted onto the light-emitting device of the invention structured by a TFT substrate 1002 and a counter substrate 1001. The invention can adopt the mounting method described in Embodiment 6. The stick-shaped IC 1003 may be a source signal line driver circuit, a gate signal line driver circuit, a controller, or the like.

FIG. 10B illustrates a leading out of a bus line (a signal line) in the case of using a stick-shaped IC. Shown in FIG. 10B are a TFT substrate 1004, a counter substrate 1005, a bus line 1006, and a pixel 1007. The stick-shaped IC can be formed to have the same length as a pixel portion, therefore a pixel pitch and a terminal pitch can be made equal. In the case of a single-crystalline IC chip, generally, the IC chip has a length of 2 to 3 cm and a number of terminals which are provided to be equal in length to the length of the IC chip, resulting in the terminal pitch of about 50 μm that is generally narrower than the pixel pitch. It requires a large area for leading a wiring over the TFT substrate. On the other hand, in the case of a stick-shaped IC, this problem does not occur.

Embodiment 8

Figure 11:
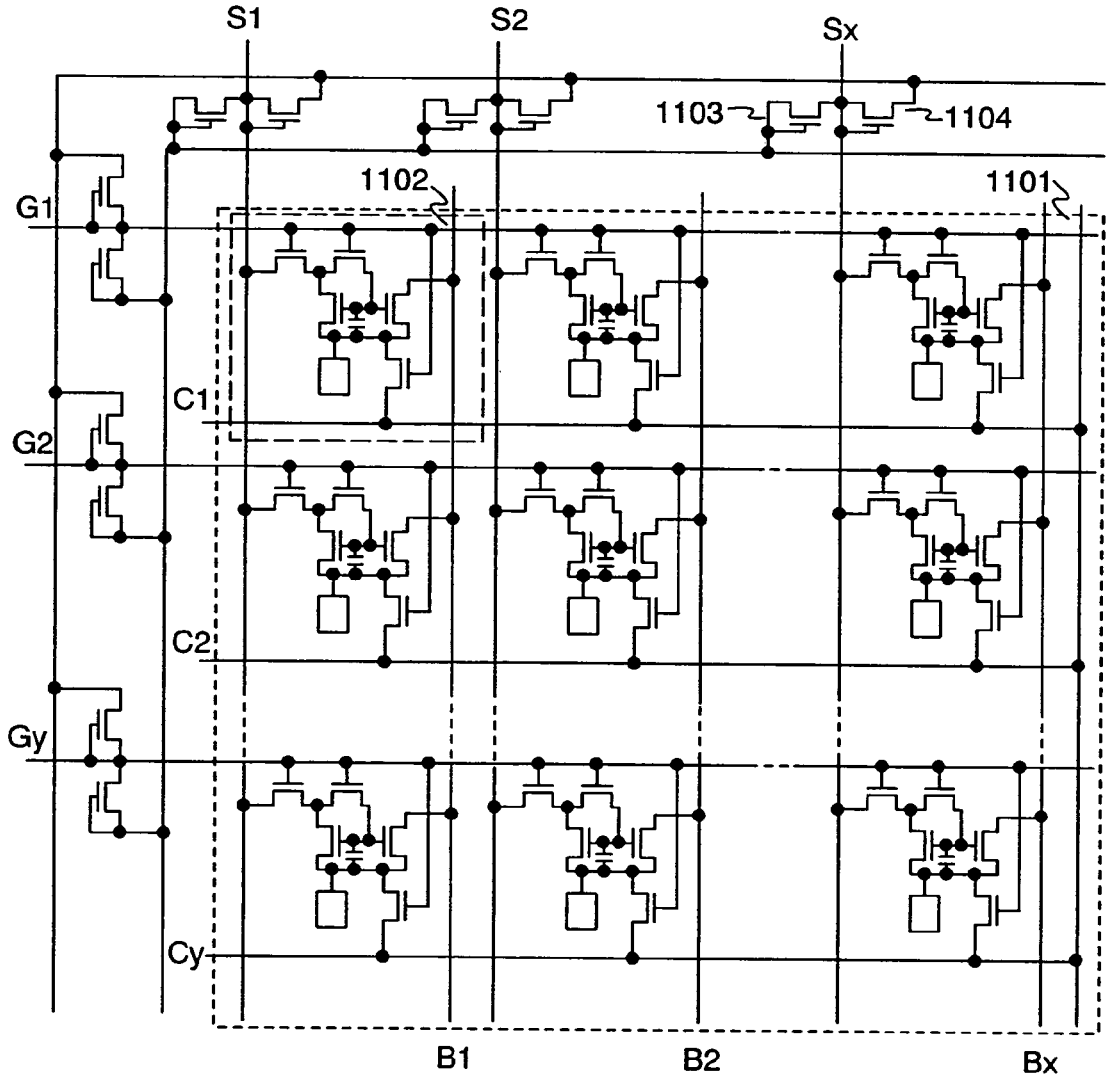
FIG. 11 is a diagram illustrating a protection circuit for a pixel portion of a light-emitting device of the invention.
Figure 12:
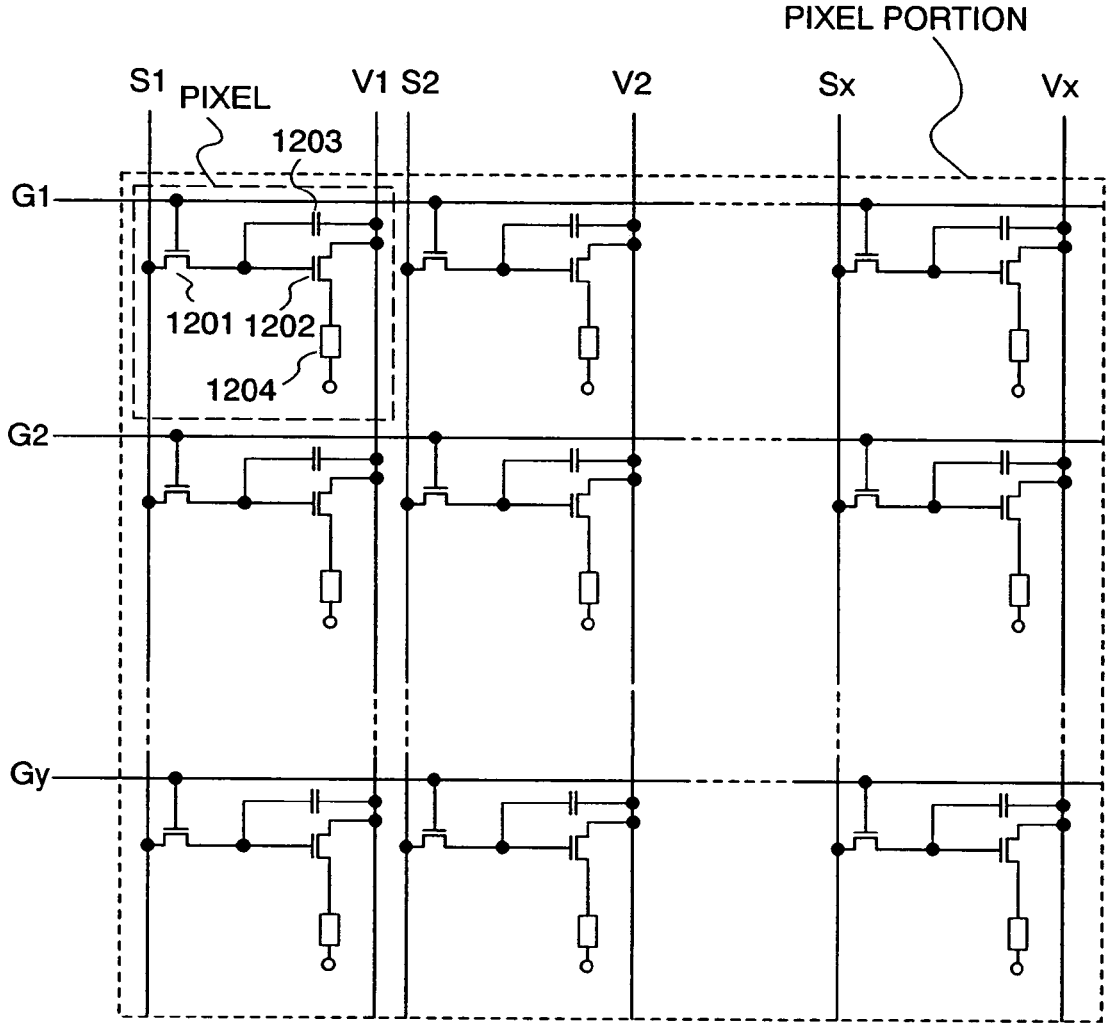
FIG. 12 is a diagram illustrating a circuit configuration of a pixel of a conventional light-emitting device.
Figure 14:
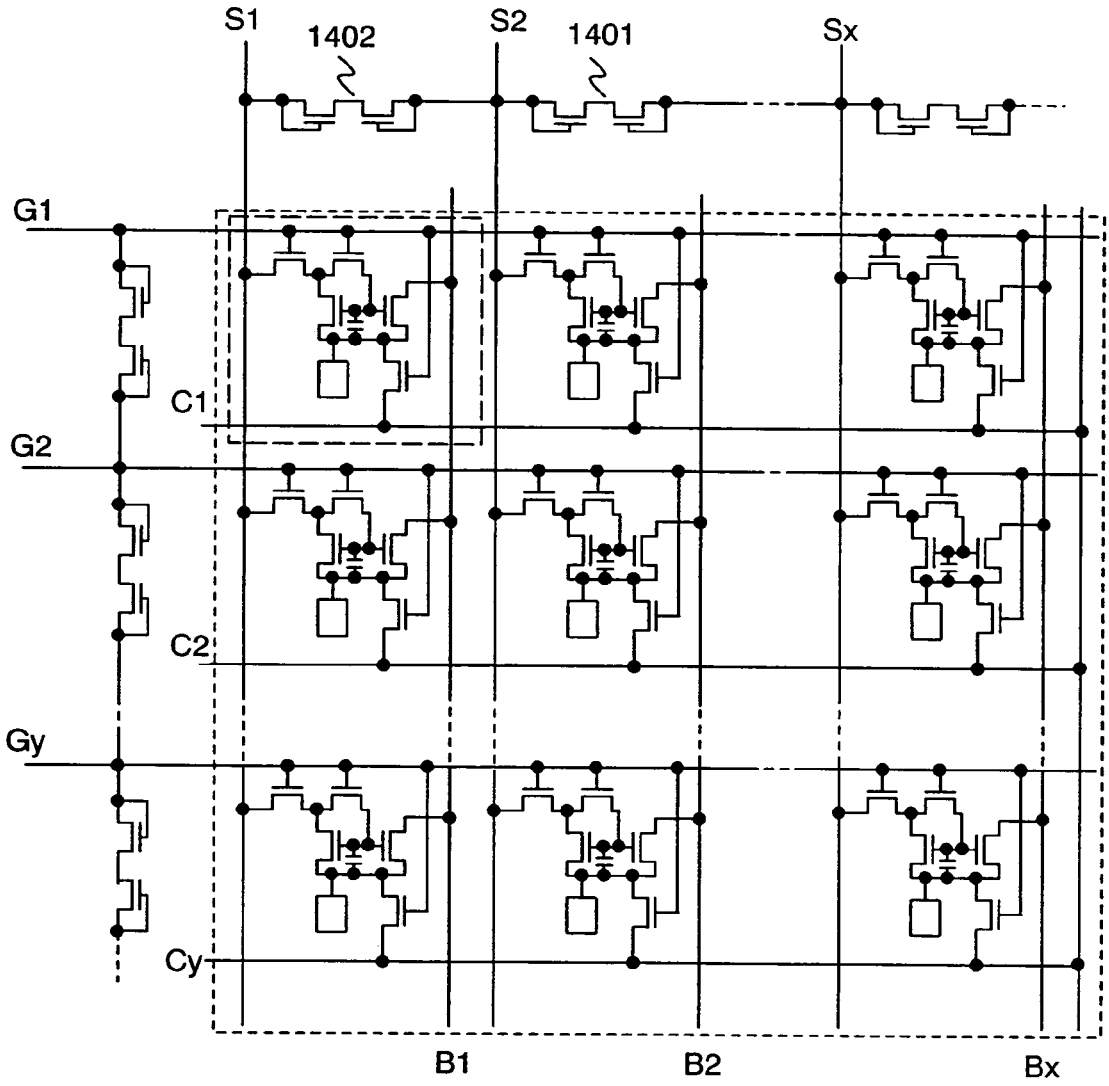
FIG. 14 is a diagram illustrating a protection circuit for a pixel portion of a light-emitting device of the invention.

FIG. 11 shows a pixel portion of the invention. In FIG. 11, protection elements 1103 and 1104 are provided around a pixel portion 1101 including a pixel 1102. Such protection elements can prevent static electricity. The protection element is formed by the same step as a TFT of a pixel. Although the protection elements shown in FIG. 11 are provided between a common wiring and each of signal lines, it is also possible to provide each of protection elements 1401 and 1402 between adjacent signal lines as shown in FIG. 14.

Embodiment 9

This embodiment is described with reference to FIGS. 16A to 16D and FIGS. 17A and 17B. First, a manufacturing method of a light-emitting display device having a channel-protected type thin film transistor in which the invention is applied to the formation of a gate electrode and a source/drain wiring is described with reference to FIGS. 16A to 16D and FIG. 17A.

A base film 1601 for improving adhesiveness is formed over a substrate 1600 as a base pretreatment. A glass substrate such as a barium borosilicate glass and an alumino borosilicate glass, a quartz substrate, a silicon substrate, a metal substrate, a stainless substrate, or a plastic substrate having enough heat resistance to a process temperature of the manufacturing step of the invention can be employed as the substrate 1600.

The base film 1601 is preferably formed of an adhesive member, so that the adhesiveness between a pattern and a region to be formed the pattern by a liquid droplet ejection method is improved. For example, oxide of titanium, vanadium, or chromium, or an organic-based material is preferably employed. Alternatively, a material in which the skeleton structure is formed by combining an organic material (an organic resin material) (polyimide, acrylic) or silicon (Si) and oxygen with each other and at least hydrogen is contained as a substituent, or at least one of fluorine, alkyl, and aromatic hydrocarbon is contained as a substituent may be employed.

Figure 18:
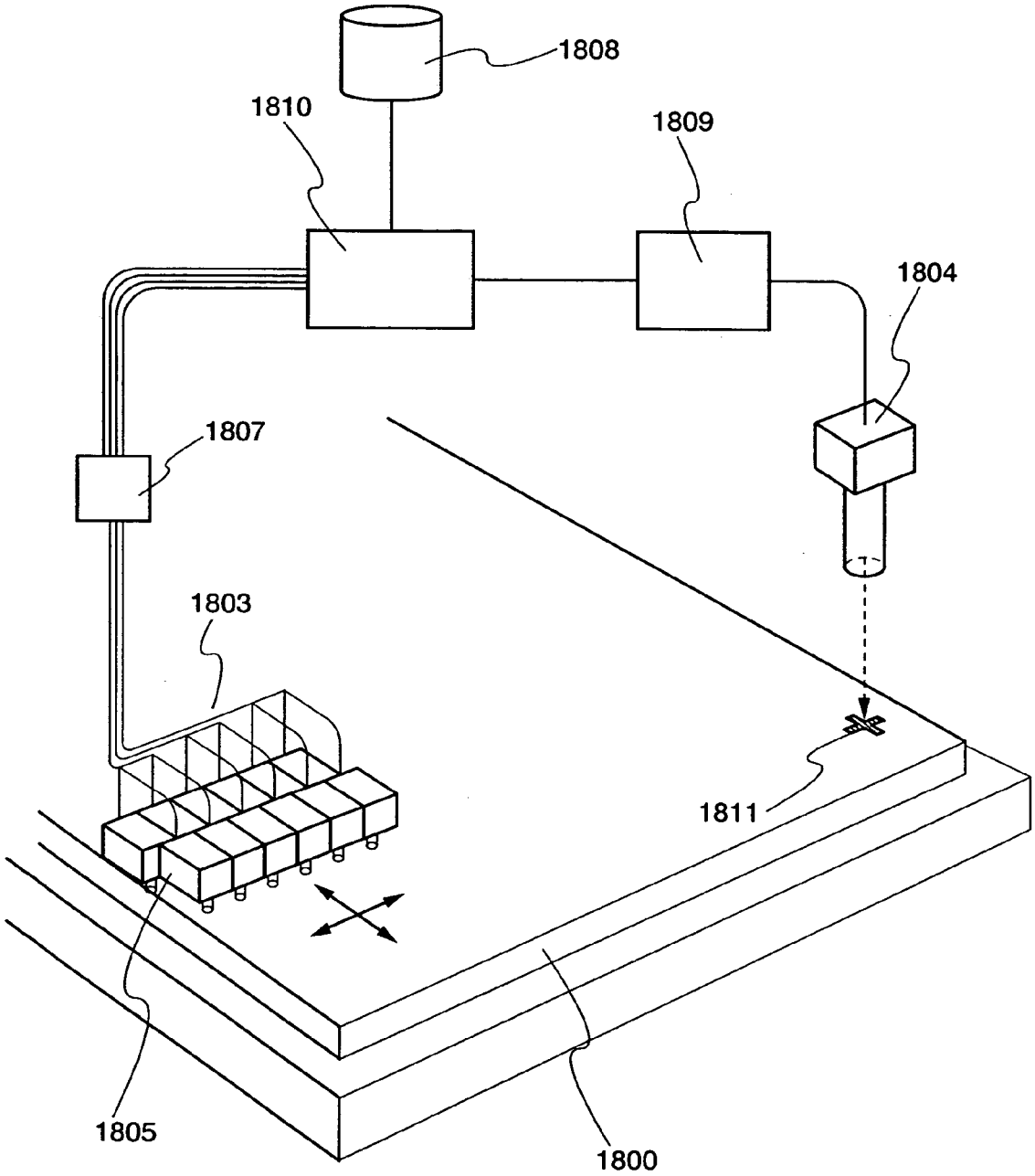
FIG. 18 is a schematic diagram of a liquid droplet ejection apparatus.

Next, a composition containing a conductive material is ejected to form conductive films 1602 and 1603 each of which serves as a gate electrode. FIG. 18 illustrates one mode of a liquid droplet ejection apparatus which can be used in this step. A liquid droplet ejection means has a means for ejecting a liquid droplet, which includes a nozzle equipped with a component ejection opening and a head having one or a plurality of the nozzles.

Each head 1805 of a liquid droplet ejection means 1803 is connected to a control means 1807. A computer 1810 controls the control means 1807, thereby a programmed pattern can be drawn. A timing to draw may be, for example, determined on the basis of a marker 1811 formed on a substrate 1800. Alternatively, a base point may be determined on the basis of the edges of the substrate 1800. This is detected by an image pickup means 1804 such as a CCD, and converted into a digital signal by an image processing means 1809. The computer 1810 recognizes the digital signal and generates a control signal which is sent to the control means 1807. Since pattern data to be formed over the substrate 1800 has been stored in a memory medium 1808, it is possible to send a control signal to the control means 1807 based on the pattern data and control each of the heads 1805 of the liquid droplet ejection means 1803 separately. Each of the heads 1805 can eject a conductive material, an organic material, an inorganic material, or the like separately to draw. In addition, in the case of drawing over the large area such as an interlayer film, the same material can be ejected from a plurality of nozzles to draw, so that throughput can be improved. When a large substrate is used, the head 1805 can scan arbitrarily over the substrate and set the drawn area arbitrarily, so that a plurality of the same patterns can be drawn over one substrate.

Each nozzle of the liquid droplet ejection means 1803 is set that the diameter is 0.02 to 100 μm (preferably 30 μm or less) and the quantity of component ejection is 0.001 to 100 pl (preferably 10 pl or less). The quantity of component ejection is increased proportionately to the diameter of the nozzle. It is preferable that a distance between a surface to form a pattern and an orifice of the nozzle be 0.1 to 3 mm (preferably 1 mm or less). With a short distance like this, landing precision of the liquid droplets is increased.

As for the composition ejected from the orifice, a conductive material with dissolved or dispersed in a solvent is employed. The conductive material includes a metal such as silver (Ag), gold (Au), copper (Cu), nickel (Ni), platinum (Pt), palladium (Pd), iridium (Ir), rhodium (Rh), tungsten (W), and aluminum (Al), a metal sulfide such as cadmium (Cd) and zinc (Zn), an oxide of Iron (Fe), titanium (Ti), silicon (S), germanium (Ge), zirconium (Zr), or barium (Ba), nanoparticles of silver halide, and dispersive nanoparticles. In addition, it may be indium tin oxide (ITO), ITSO which is made of indium thin oxide and silicon oxide, organic indium, organic tin, zinc oxide, titanium nitride (TiN) or the like each of which used as a transparent conductive film. However, the composition is preferably a material of gold, silver, or copper with dissolved or dispersed in a solvent in consideration of the resistivity value. It is further preferable that silver or copper having lower resistance is used. In the case of using silver or copper, a barrier film may also be provided as a measure for impurities. As the barrier film, a silicon nitride film or nickel boron (NiB) may be used.

In addition, the composition ejected from the orifice may be such particles that a conductive material is coated with another conductive material to have a plurality of layers. For example, a particle having a three-layer structure in which copper is coated with nickel boron (NiB) and silver in this order may be used. As the solvent, esters such as butyl acetate and ethyl acetate, alcohols such as isopropyl alcohol and ethyl alcohol, organic solvents such as methyl ethyl ketone and acetone, or the like is used. Preferably, the viscosity of the composition is set at 50 cp or less so that dryness is prevented or the composition is smoothly ejected from an orifice. The surface tension of the composition is preferably 40 mN/m or less. The viscosity of the composition and the like can be appropriately adjusted in accordance with a used solvent and the intended use. For example, the viscosity of a composition in which ITO, organic indium, or organic tin is dissolved or dispersed in a solvent is 5 to 50 mPa·S, the viscosity of a composition in which silver is dissolved or dispersed in a solvent is 5 to 20 mPa·S, and the viscosity of a composition in which gold is dissolved or dispersed in a solvent is 10 to 20 mPa·S.

Note that the conductive layer may be formed by laminating a plurality of conductive materials. Alternatively, plating with copper can be applied to a conductive layer which is formed by an liquid droplet election method using silver as a conductive material. Electroplating or chemical (electroless) plating can be applied. The plating is carried out such that a surface of the substrate is immersed into a container filled with a solution of a plating material, or the substrate is placed slant (or perpendicular) and a solution of a plating material is flowed to a surface of the substrate. The latter method is advantageous in that the step apparatus can be downsized.

It is preferable that the diameter of the conductive particle be as small as possible for preventing clogging of the nozzle and for forming a fine pattern, although it is dependent on the diameter of each nozzle and a desired pattern shape. The diameter of a particle is preferably 0.1 μm or less. The composition is formed by a known method such as an electrolyzing method, an atomizing method, and a wet reducing method and its particle size is generally about 0.01 to 10 μm. However, when the composition is formed by a gas evaporation method, a nano-molecule protected by a dispersion agent is about 7 nm, which is minute. When the surfaces of the nano-particles are covered by a coating agent, the nano-particles are not coagulated in the solvent and they are dispersed stably at a room temperature. That is, the nano-particles exhibit substantially the same behavior as that of liquid. Therefore, it is preferable to use a coating agent.

A step of ejecting a composition is preferably carried out under low pressure for volatilizing a solvent of the composition while the composition is ejected and land to a substrate, which enables to omit later steps of drying and baking. The composition ejection under low pressure is further preferable in that an oxide film or the like is not formed over a surface of the conductive film. After ejecting a composition, at least one of steps of drying and baking is carried out. The steps of drying and baking are both steps of heat treatment. However, drying is carried out at 100° C. for 3 minutes and baking is carried out at 200 to 350° C. for 15 to 120 minutes, for example, thus object, temperature, and time differ from each other. Respective steps of drying and baking are carried out by laser irradiation, rapid thermal annealing, heating furnace, or the like under atmospheric pressure or low pressure. Note that timing of respective heat treatments is not particularly limited. In order to carry out the steps of drying and burning well, a substrate may be heated at 100 to 800° C. (preferably, 200 to 350° C.), though the temperature depends on a material of the substrate and the like. Through the above-mentioned steps, a solvent in a composition is volatilized or its dispersant agent is removed chemically, and its surrounding resin cures and shrinks, thereby bringing adjacent nano-particles into contact with each other and accelerating fusion and welding.

After forming the conductive layers 1602 and 1603 each of which serves as a gate electrode, it is preferable that an exposed base film is processed by one of the following two steps.

The first method is a step of insulating the base film 1601 which is not overlapped with the conductive layers 1602 and 1603 to form an insulating layer. That is, the base film 1601 which is not overlapped with the conductive layers 1602 and 1603 is oxidized to be isolated. In the case where the base film 1601 is oxidized to be isolated, it is preferable that the base film 1601 is formed to have a thickness of 0.01 to 10 nm in order to carry out the oxidation easily. As a method for oxidation, a method of exposing in an oxygen atmosphere or a method of a heat treatment can be adopted.

The second method is a step of etching the base film 1601 by using the conductive layers 1602 and 1603 as masks to be removed. In the case of adopting this method, the thickness of the base film 1601 is not particularly limited.

Another method of the base pre-treatment is plasma treatment to a formed region (a surface to be formed). The plasma treatment is carried out such that air, oxygen, or nitride is used as a process gas and a pulsed voltage is applied with a pressure of dozens of Torr to 1000 Torr (133000 Pa). The pressure is an atmospheric pressure or close to the atmospheric pressure, that is, preferably 100 (13300 Pa) to 1000 Torr (133000 Pa), and more preferably 700 (93100 Pa) to 800 Torr (106400 Pa). At this time, the plasma concentration is set at $1\times10^{10}$ to $1\times10^{14}$ $m^{-3}$, that is, set to be the corona discharge state or the glow discharge state. The plasma treatment using the treatment gas such as air, oxygen, or nitride enables a surface modification without depending on its material. Consequently, a surface modification for any material can be achieved.

Figure 16A:
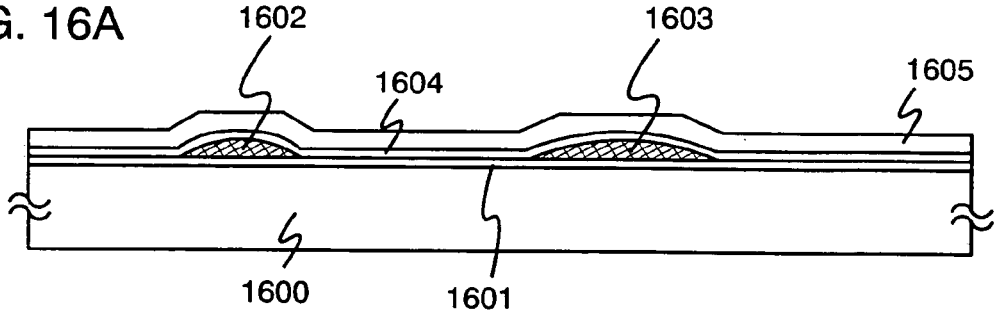
FIGS. 16A to 16D are diagrams each illustrating a step of manufacturing the invention by means of a liquid droplet ejection apparatus.

Subsequently, a gate insulating film is formed over the conductive layers 1602 and 1603 (see FIG. 16A). The gate insulating film may be formed of either a single layer or a laminated layer by using a known material such as an oxide material or a nitride material of silicon. For example, a three-layer structure of a silicon nitride film, a silicon oxide film, and a silicon nitride film, or a single layer or a two-layer structure of a silicon oxynitride film may be used. In this embodiment, a silicon nitride film is used for an insulating layer 1604 and a silicon nitride oxide film is used for an insulating film 1605. Preferably, a silicon nitride film that has the precise film quality is used. In the case where the conductive layer is formed by silver, copper, or the like by the liquid droplet ejection method, it is effective that a barrier film such as a silicon nitride film or an NiB film is formed over the conductive layer in order to prevent impurity diffusion and flatter its surface. Note that in order to form a precise insulating film having less gate leak current at a low film forming temperature, a rare gas element such as argon may be mixed into a reaction gas to be mixed into the insulating film.

Figure 16B:
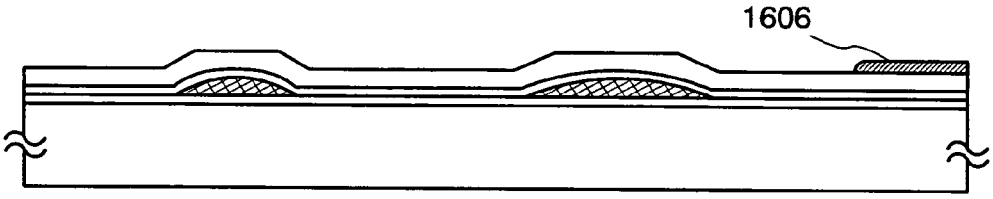
Figure 16C:
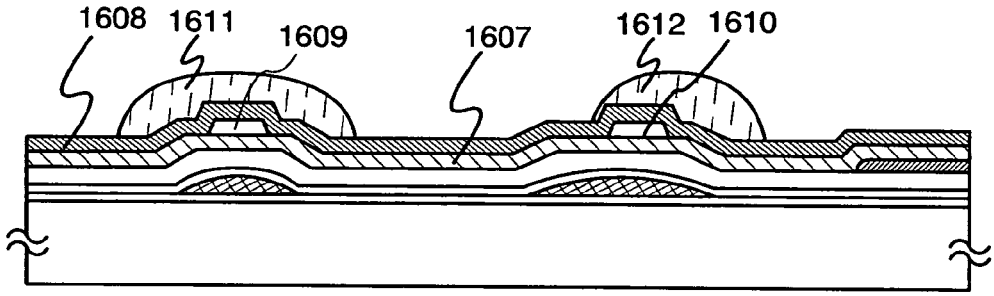

Subsequently, a conductive layer (also called a first electrode) 1606 is formed over the gate insulating film by selectively ejecting a composition containing a conductive material (see FIG. 16B). In the case where light is irradiated from the substrate 1600 side or a transmissive light-emitting device is manufactured, the conductive layer 1606 may be formed such that a desired pattern is formed using a composition containing indium tin oxide (ITO), ITSO which is made of indium thin oxide and silicon oxide, zinc oxide (ZnO), tin oxide ($SnO_2$), or the like, and then baking.

Preferably, the conductive layer 1606 is formed by a sputtering using indium tin oxide (ITO), ITSO which is made of indium thin oxide and silicon oxide, zinc oxide (ZnO) or the like. More preferably, in the sputtering, indium tin oxide containing silicon oxide formed by using a target made of ITO containing silicon oxide of 2 to 10% by weight is employed. Furthermore, a conductive oxide material in which silicon oxide is contained and zinc oxide (ZnO) of 2 to 20% by weight is mixed into indium oxide may be employed. After forming the first electrode 1606 by the sputtering, a mask layer is formed by a liquid droplet ejection method and etched to be a desired pattern. In this embodiment, the conductive layer 1606 is formed by a liquid droplet ejection method using a light transmissive conductive material, specifically, indium tin oxide (ITO) or ITSO which is made of indium thin oxide and silicon oxide. As is in forming the conductive layers 1602 and 1603, a photocatalyst material may be formed in a region for the conductive layer 1606, though not shown in the drawing. Due to the photocatalyst material, the adhesiveness is improved so that the conductive layer 1606 can be formed with a desired pattern divided finely. The conductive layer 1606 corresponds to a first electrode which serves as a pixel electrode.

In this embodiment, the gate insulating layer is formed by laminating three layers of a silicon nitride film, a silicon oxynitride film (a silicon oxide film), and a silicon nitride film in this manner as described above. It is a preferable structure that the first electrode 1606 made by indium tin oxide containing silicon oxide is formed close to the silicon nitride film of the gate insulating layer 1605, thereby a rate of irradiating light from an electroluminescent layer to outside can be improved.

On the other hand, in the case where the emitted light is irradiated to the opposite side to the substrate 1600 side, a composition containing mainly a particle of a metal such as silver (Ag), gold (Au), copper (Cu), tungsten (W), and aluminum (Al) can be used for forming the first electrode layer 1606. It is also a method for forming the first electrode layer 1606 that a transparent or light reflective conductive film is formed by a sputtering method, and a mask pattern is formed by a liquid droplet ejection method to be etched.

The first electrode layer 1606 may be polished by a CMP method or by cleaning with porous polyvinyl alcohol to flatter the substrate. After polishing by the CMP method, an ultraviolet light irradiation or oxygen plasma treatment may be carried out to a surface of the first electrode layer 1606.

A semiconductor layer can be formed by a known method (e.g., a sputtering method, an LPCVD method, a plasma CVD method). A material of the semiconductor layer is not particularly limited, though a silicon or silicon-germanium (SiGe) alloy is preferably used.

The semiconductor layer employs an amorphous semiconductor (typically amorphous silicon hydride) or a crystalline semiconductor (typically poly-silicon) as a material. The poly-silicon includes so-called high temperature poly-silicon which is mainly made of polycrystalline silicon at a process temperature of 800° C. or more, so-called low temperature poly-silicon which is mainly made of polycrystalline silicon at a process temperature of 600° C. or less, and a crystalline silicon which is crystallized by adding an element for promoting crystallization.

A semi-amorphous semiconductor or a semiconductor in which a part of its semiconductor layer contains a crystal phase may be employed as well. The semi-amorphous semiconductor is a semiconductor having an intermediate structure between amorphous and crystalline (including single crystalline and polycrystalline) structures. This semiconductor has a third state that is stable in free energy, and it is a kind of a crystalline semiconductor that has a short range order and a lattice distortion. Typically, the semi-amorphous semiconductor film contains silicon as a main component and in which Raman spectrum is shifted to the lower frequency band than 520 $cm^{-1}$ with a lattice distortion. Further, the semiconductor is mixed with at least 1 atom % of hydrogen or halogen as a neutralizing agent for dangling bond. Such a semiconductor is called herein a semi-amorphous semiconductor (hereinafter called a SAS). The SAS is also referred to as a so-called micro-crystalline semiconductor (typically micro-crystalline silicon).

A SAS is formed by depositing silicon gas by glow discharge (plasma CVD). The silicon gas is typically $SiH_4$, as well as $Si_2H_6$, $SiH_2Cl_2$, $SiHCl_3$, $SiCl_4$, $SiF_4$ and the like. $GeF_4$ or $F_2$ may be mixed into the silicon gas. By diluting the silicon gas with hydrogen, or hydrogen and one or a plurality of rare gas elements of helium, argon, krypton, or neon, A SAS can be formed easily. The silicon gas is preferably diluted by the hydrogen with the dilution flow ratio of 2 to 1000 times. The SAS formation by the glow discharge decomposition is preferably carried out under low pressure of course, though may be carried out under atmospheric pressure. The glow discharge is typically carried out at a pressure of 0.1 to 133 Pa. The glow discharge is generated with a power frequency of 1 to 120 MHz, more preferably of 13 to 60 MHz. High frequency power can be set arbitrary. It is preferable that a temperature for heating the substrate is 300° C. or less, more preferably 100 to 200° C. Among impurity elements which are mainly added in forming the film, atmospheric elements such as oxygen, nitrogen and carbon desirably have a concentration of $1\times10^{20}$ $cm^{-3}$ or less. In particular, the concentration of oxygen is $5\times10^{19}$ $cm^{-3}$ or less, more preferably $1\times10^{19}$ $cm^{-3}$ or less. By containing a rare gas element such as helium, argon, krypton, neon, or the like, the lattice distortion is further promoted and stability is improved, thereby a good SAS can be obtained. A semiconductor layer may be formed such that a SAS layer made by a hydrogen-based gas is laminated over a SAS layer made by a fluorine based gas.

In the case where a crystalline semiconductor film is used as the semiconductor layer, it can be formed by a known method (e.g., a laser crystallization method, a thermal crystallization method, a thermal crystallization method using an element for promoting crystallization such as nickel). In the case of adding no element for promoting crystallization, heating is carried out at 500° C. under nitrogen atmosphere for 1 hour before irradiating laser light to an amorphous film, thereby a hydrogen concentration of the amorphous film is reduced to $1\times10^{20}$ atoms/$cm^3$ or less. The reason is that an amorphous silicon film containing a large quantity of hydrogen is destroyed by a laser irradiation.

A method for injecting a metal element into an amorphous semiconductor layer is not particularly limited as long as the metal element is injected on a surface or in an inside of the amorphous semiconductor layer, and for example, a sputtering method, a CVD method, a plasma treatment method (including a plasma CVD method), an absorption method, or a method of applying a solution of metallic salt can be adopted. In particular, the solution application method is advantageous in that it is an easy and simple way and the concentration of a metal element can be easily controlled. At this solution application method, an oxide film is preferably formed by an UV light irradiation in an oxygen atmosphere, a thermal oxidation, a treatment with ozone water or hydrogen peroxide containing hydroxyl radical, or the like in order to improve wettability of the surface of the amorphous semiconductor film and spread the solution over an entire surface thereof.

An amorphous semiconductor layer can be crystallized by heat treatment and a laser light irradiation or by one of the heat treatment and the laser light irradiation at plural times.

As a semiconductor, an organic semiconductor made of an organic material may be used. For the organic semiconductor, a low molecular weight material, a high molecular weight material, or the like is used, as well as an organic dye, a conductive high molecular weight material, and the like.

In this embodiment, an amorphous semiconductor is used as a semiconductor. An amorphous semiconductor layer 1607 is formed, and channel protection films 1609 and 1610 are formed such that, for example, an insulating film is formed by a plasma CVD method and patterned so as to be a desired shape at a desired region. At this time, the back surface of the substrate is exposed by using the gate electrode as a mask to form the channel protection films 1609 and 1610. Alternatively, the channel protection films 1609 and 1610 may be formed by a liquid droplet ejection method using polyimide, polyvinyl alcohol, or the like, thereby an exposure step can be omitted. A semiconductor layer of one conductivity type such as an N-type semiconductor layer 1608 is formed subsequently by a plasma CVD and the like (see FIG. 16C). The semiconductor layer of one conductivity type is formed as required.

As the channel protection film, a film made of one or a plurality of materials of an inorganic material (e.g., silicon oxide, silicon nitride, silicon oxynitride, silicon oxide nitride), a photosensitive or non-photosensitive organic material (an organic resin material) (e.g., polyimide, acrylic, polyamide, polyimideamide, resist, benzocyclobutene), a low-k material having low permittivity, or the like, or a layer laminated these films can be used. Alternatively, a material in which the skeleton structure is formed by combining silicon (Si) and oxygen (O) with each other and at least hydrogen is contained as a substituent, or at least one of fluorine, alkyl, and aromatic hydrocarbon is contained as a substituent may be employed. As a forming method, a vapor deposition method such as a plasma CVD method and a thermal CVD method or a sputtering method can be adopted. In addition, a liquid droplet ejection method or a printing method (e.g., a screen printing method and a offset printing method each of which forms a pattern) can be adopted as well. A TOF layer or a SOG layer obtained by an application method may be used.

Subsequently, masks 1611 and 1612 made of an insulator such as resist and polyimide are formed. The amorphous semiconductor layer 1607 and the N-type semiconductor layer 1608 are patterned at the same time using the masks 1611 and 1612.

Figure 16D:
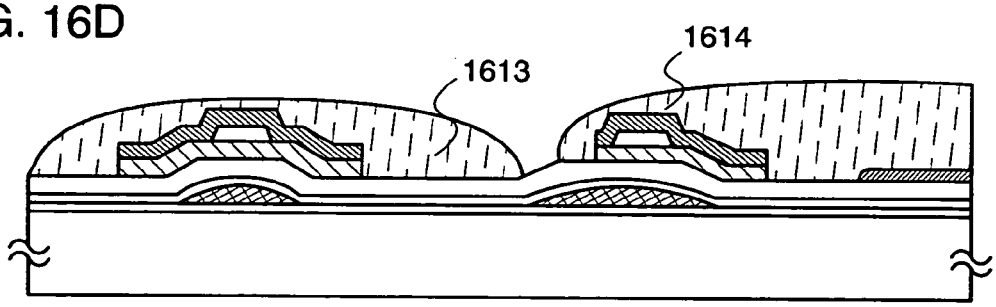

Then, masks 1613 and 1614 are formed by a liquid droplet ejection method using an insulator such as resist and polyimide (see FIG. 16D). A contact hole 1718 is formed at the gate insulating layers 1605 and 1604 by an etching process using the masks 1613 and 1614 such that some portion of the conductive layer 1603 which serves as a gate electrode layer underlying the gate insulating layer 1604 appears. A plasma etching (a dry etching) or a wet etching can be adopted either, although a plasma etching is preferable in the case of a large substrate. A fluorine-based gas or a chlorine-based gas such as $CF_4$, $NF_3$, $Cl_2$, and $BCl_3$ is employed as an etching gas, and an inert gas such as He and Ar may be mixed as required. In the case where an etching process by an atmospheric discharge is adopted, a local discharge process can be carried out and a mask layer is not required to form over an entire surface of the substrate.

Figure 17A:
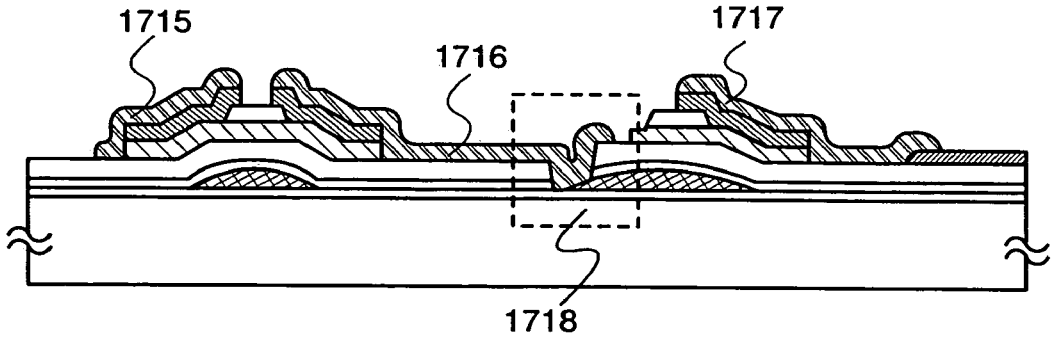
FIGS. 17A and 17B are diagrams each illustrating a step of manufacturing the invention by means of a liquid droplet ejection apparatus.

After removing the masks 1613 and 1614, conductive layers 1715, 1716, and 1717 are formed by ejecting a composition containing a conductive material, and the N-type semiconductor layer 1608 is patterned using the conductive layers 1715, 1716, and 1717 as masks to form an N-type semiconductor layer (see FIG. 17A). Before forming the conductive layers 1715, 1716, and 1717, the base pretreatment of selectively forming a photocatalyst material to a portion where the conductive layers 1715, 1716, and 1717 contact with the gate insulating film 1605 may be carried out, though not shown in the drawing, thereby the conductive layers 1715, 1716, and 1717 can be formed with high adhesiveness.

It is also possible that the step of forming a base film is carried out as a base pretreatment of a conductive layer formed by a liquid droplet ejection method, and the same treatment is carried out after forming the conductive layer. According to this, adhesiveness between the conductive layers is improved, so that reliability of a light-emitting display device can be improved.

The conductive layer 1717 are formed to connect electrically to the first electrode 1606, which serves as a source or drain wiring layer. The source or drain wiring layer 1716 and the conductive layer 1603 which is a gate electrode layer are electrically connected to each other at a contact hole 1718 formed at the gate insulating layer 1605. As a conductive material for these wiring layers, a composition containing mainly a particle of a metal such as silver (Ag), gold (Au), copper (Cu), tungsten (W), and aluminum (Al) may be employed. Indium tin oxide (ITO); ITSO which is made of indium tin oxide and silicon oxide; organic indium; organic tin; zinc oxide; titanium nitride or the like each of which has translucency may be employed as well.

The step of forming the contact hole 1718 at the gate insulating films 1605 and 1604 may be carried out after forming the wiring layers 1715, 1716, and 1717 using them as masks. In this case, a conductive layer is formed in the contact hole 1718 to electrically connect the wiring layer 1716 and conductive layer 1603 which is a gate electrode layer to each other.

Figure 17B:
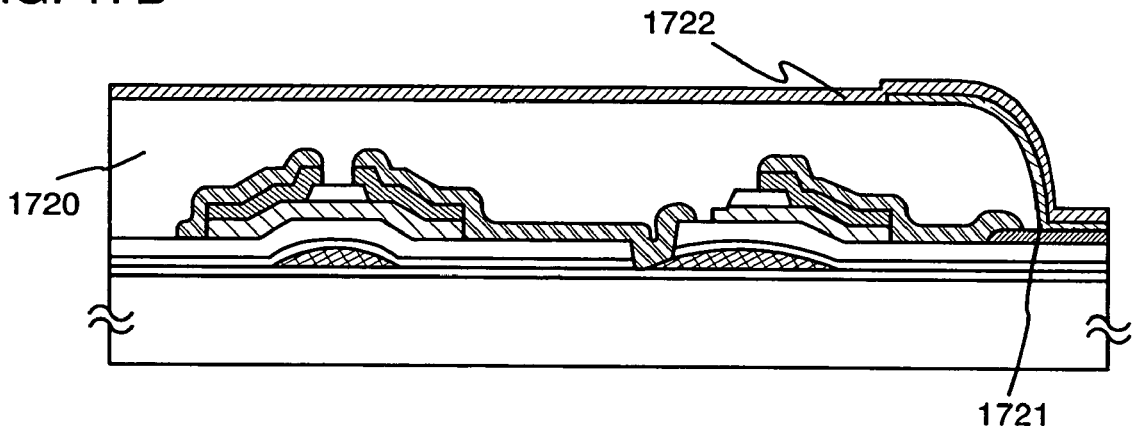

Subsequently, an insulating layer 1720 is formed, which serves as a bank (also called a partition). Note that a protective layer of silicon nitride or silicon oxide nitride may be formed entirely under the insulating layer 1720 so as to cover a thin film transistor, though not shown in the drawing. The insulating layer 1720 is formed entirely by a spin coating method or a dipping method and etched to form a contact hole as shown in FIG. 17B. In the case where the insulating layer 1720 is formed by a liquid droplet ejection method, the etching process is not necessarily required. In the case of a liquid droplet ejection method for forming a wide region such as the insulating layer 1720, a composition is preferably ejected from a plurality of nozzles of a liquid droplet ejection apparatus such that a plurality of lines are overlapped, thereby throughput can be improved.

The insulating layer 1720 is formed provided with an opening of a contact hole in accordance with a position where a pixel is formed corresponding to the first electrode 1721. This insulating layer 1720 can be formed by an inorganic insulating material such as silicon oxide, silicon nitride, silicon oxynitride, aluminum oxide, aluminum nitride, and aluminum oxynitride, acrylic acid, methacrylic acid, and a derivative thereof, a high molecular weight material having heat resistance such as polyimide, aromatic polyamide, or polybenzimidazole, an inorganic siloxane insulating material having a Si—O—Si bond, among the compound made by silicon, oxygen, and hydrogen, formed by using a siloxane-based material as a start material, or an organic siloxane insulating material in which hydrogen over silicon is substituted by an organic group such as methyl or phenyl. It is preferable to form the insulating layer 1720 by a photosensitive or non-photosensitive material such as acrylic or polyimide, because the edge thereof has a shape in which a curvature radius varies continuously and a thin film in the upper layer is formed without a step disconnection.

Through the above-mentioned steps, a TFT substrate for an EL display panel is completed in which a channel protection type TFT of a bottom gate type (also called a reverse stagger type) and the first electrode (the first electrode layer) are connected over the substrate 1600.

Before forming the electroluminescence layer 1721, heat treatment is carried out at 200° C. under atmospheric pressure to remove the moisture adsorbed in the insulating layer 1720 or on the surface thereof. Subsequently, it is preferable that heat treatment is carried out at 200 to 400° C., preferably 250 to 350° C. under low pressure and then a vacuum vapor deposition method or a liquid droplet ejection method under low pressure is carried out without exposing to atmosphere to form the electroluminescence layer 1721.

Materials each emitting red (R), green (G) or blue (B) light are selectively deposited as the electroluminescence layer 1721 by a vapor deposition method using a deposition mask. Respective light-emitting materials of red (R), green (G) and blue (B) can be deposited by a liquid droplet ejection method using a low or high molecular weight material or the like as is in the case of a color filter, which is preferable in that RGB can be separately colored without using a mask. A conductive layer 1722 which serves as a second electrode is formed over the electroluminescence layer 1721. Accordingly, a light-emitting display device having a display function due to a light-emitting element is completed (see FIG. 17B).

It is effective to provide a passivation film so as to cover the second electrode 1722, though not shown in the drawing. The passivation film is made by an insulating film of silicon nitride (SiN), silicon oxide ($SiO_2$), silicon oxynitride (SiON), silicon nitride oxide (SiNO), aluminum nitride (AlN), aluminum oxynitride (AlON), aluminum nitride oxide (AlNO) which contains more nitrogen than oxygen, aluminum oxide, diamond like carbon (DLC), or a carbon nitride film (CNx). The passivation film is formed by the single-layer insulating film or a laminated layer of these insulating films. For example, a laminated layer of a carbon nitride film (CNx) and silicon nitride may be used. In addition, an organic material can be employed as well, and a laminated layer of high molecular weight such as styrene polymer may be used. Alternatively, a material in which the skeleton structure is formed by combining silicon (Si) and oxygen (O) with each other and at least hydrogen is contained as a substituent, or at least one of fluorine, alkyl, and aromatic hydrocarbon is contained as a substituent may be employed.

As described hereinabove, in this embodiment, a light-exposure step using a photomask is not adopted, and thus the step can be omitted. In addition, even in the case of using a glass substrate after five generations, one side of which is 1000 mm or more, a light-emitting device can be easily manufactured by forming each kind of pattern directly on a substrate by a liquid droplet ejection method.

Embodiment 10

Figure 15:
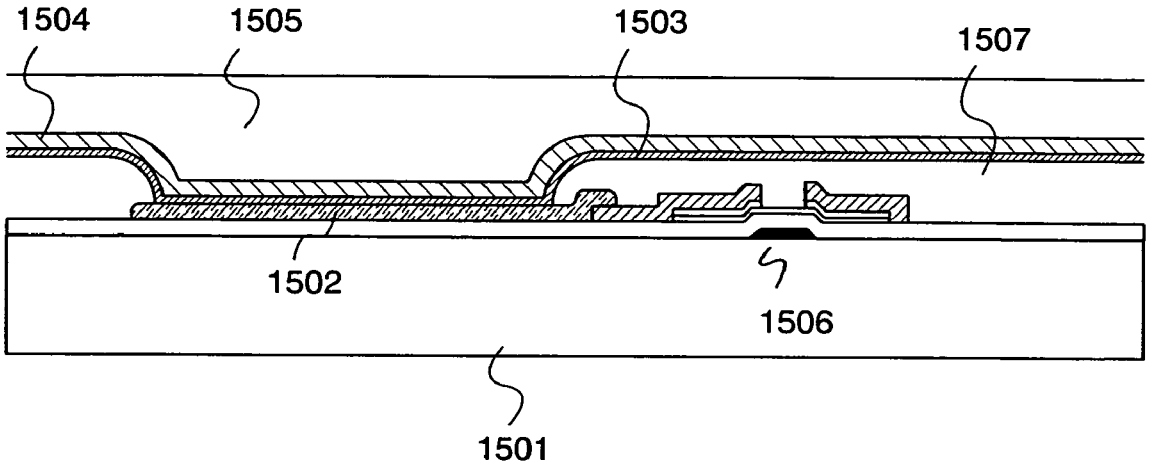
FIG. 15 is a cross-sectional diagram of a pixel portion of a light-emitting device of the invention.

FIG. 15 is a cross-sectional diagram of a pixel portion of a light-emitting device of the invention. In FIG. 15, an electroluminescence element is used as a light-emitting element. A pixel TFT 1506 is formed over a TFT substrate 1501, and an electrode 1502 is formed to connect to a drain electrode of the pixel TFT 1506. An insulating film 1507 is formed and patterned to appear the electrode 1502. Subsequently, an organic material film 1503 which serves as a light-emitting portion and an electrode 1504 are formed. As the organic material and the electrode material, known materials can be employed respectively. Depending on the combination of materials, top emission, bottom emission, or dual emission can be achieved. An area 1505 over the electrode 1504 is shielded from the outside and sealed. The sealing keeps out the external moisture and the like, and thus degradation of an EL material can be prevented.

Embodiment 11

Electronic equipment each provided with a light-emitting device according to Embodiments 1 to 10 as a display medium is described with reference to FIGS. 13A to 13C. However, electronic equipment of the invention is not limited to those in FIGS. 13A to 13C and it is to be understood that various changes and modifications will be apparent to those skilled in the art. Therefore, unless such changes and modifications depart from the scope of the invention, they should be constructed as being included therein.

Such electronic equipment includes a television, a video camera, a digital camera, a head mounted display (a goggle type display), a game machine, a car navigation system, a personal computer and a mobile phone. A specific example thereof is shown in FIGS. 13A to 13C.

Figure 13A:
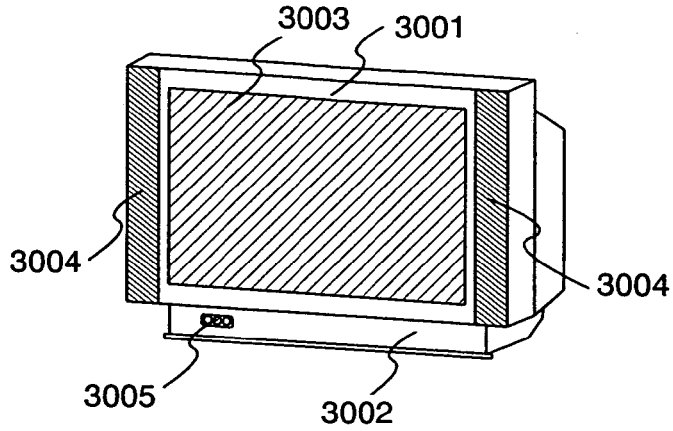
FIGS. 13A to 13C are views of electronic equipment employing a light-emitting device of the invention.

FIG. 13A illustrates a television which includes a housing 3001, a supporting base 3002, a display portion 3003, a speaker portion 3004, a video input terminal 3005. The television is manufactured by applying the light-emitting device of the invention to the display portion 3003.

Figure 13B:
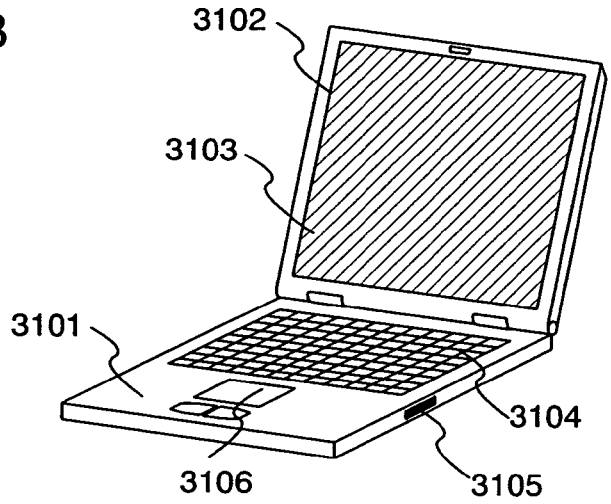

FIG. 13B illustrates a notebook computer which includes a main body 3101, a housing 3102, a display portion 3103, a keyboard 3104, an external connecting port 3105, a pointing mouth 3106. A compact and light weight notebook computer is manufactured by applying the light-emitting device of the invention to the display portion 3103.

Figure 13C:
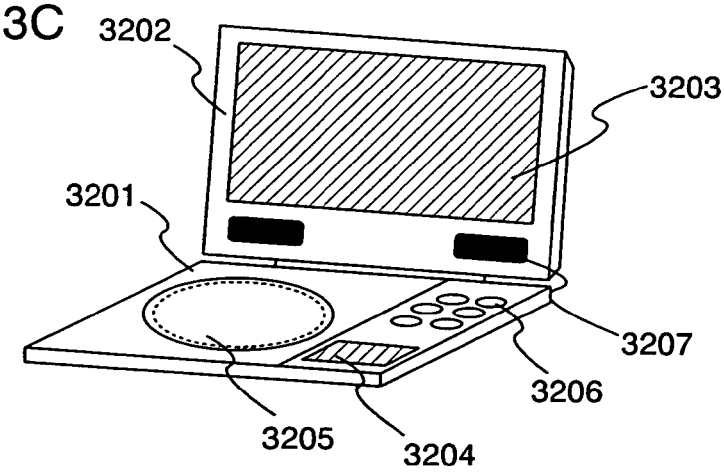

FIG. 13C illustrates an image reproducing apparatus provided with a memory medium (specifically a DVD reproducing apparatus) which includes a main body 3201, a housing 3202, a memory medium (e.g., CD, LD, and DVD) reading portion 3205, an operating switch 3206, a display portion A 3203, and a display portion B 3204. The display portion A 3203 is used mainly for displaying image data, while the display portion B 3204 is used mainly for displaying character data. The invention can be applied to the display portion A 3203 of the image reproducing apparatus provided with a memory medium. A compact and light weight image reproducing apparatus provided with a memory medium can be manufactured by applying the invention to a CD reproducing apparatus, a game machine, or the like.

As mentioned above, the application range of the invention is so wide that the invention applicable to electronic equipment in various fields. Note that the electronic equipment described in this embodiment may be implemented in combination with Embodiments 1 to 10.

This application is based on Japanese Patent Application serial no. 2003-429210 filed in Japan Patent Office on Dec. 25, 2003, the contents of which are hereby incorporated by reference.

What is claimed is:

1. A light-emitting device comprising:

a pixel, a source signal line, a gate signal line, and a power source line, the pixel comprising:

a first switch of which one terminal is connected to the source signal line, and another terminal is connected to a current-voltage conversion element;

a second switch of which one terminal is connected to the current-voltage conversion element, and another terminal is connected to a storage means and a voltage-current conversion element;

a pixel electrode which is connected to the current-voltage conversion element and the voltage-current conversion element;

a third switch of which one terminal is connected to the pixel electrode, and another terminal is connected to the power source line; and a light-emitting element of which one electrode comprises the pixel electrode.

2. A light-emitting device according to claim 1, wherein the first switch, the second switch and the third switch are controlled by the gate signal line.

3. A light-emitting device according to claim 1, wherein the first switch and the second switch are controlled by different gate signal lines.

4. A light-emitting device according to claim 1, wherein the storage means comprises a capacitor.

5. A light-emitting device according to claim 1, wherein the light-emitting device is incorporated in at least one selected from the group consisting of a television, a video camera, a digital camera, a head mounted display, a game machine, a navigation system, a personal computer, an image reproducing apparatus, and a mobile phone.

6. A light-emitting device comprising:

a pixel, a source signal line, a gate signal line, and a power source line, the pixel comprising:

a first switch of which one terminal is connected to the source signal line, and another terminal is connected to a drain terminal of a first thin film transistor;

a second switch of which one terminal is connected to the drain terminal of the first thin film transistor, and another terminal is connected to a gate terminal of the first thin film transistor, a storage means and a gate terminal of a second thin film transistor;

a pixel electrode which is connected to a source terminal of the first thin film transistor and a source terminal of the second thin film transistor;

a third switch of which one terminal is connected to the pixel electrode, and another terminal is connected to the power source line; and a light-emitting element of which one electrode comprises the pixel electrode.

7. A light-emitting device according to claim 6, wherein the source terminal of the first thin film transistor and the source terminal of the second thin film transistor are connected to a pixel electrode through a resistor.

8. A light-emitting device according to claim 6, wherein the first switch, the second switch and the third switch are controlled by the gate signal line.

9. A light-emitting device according to claim 6, wherein the first switch and the second switch are controlled by different gate signal lines.

10. A light-emitting device according to claim 6, wherein the first thin film transistor and the second thin film transistor have different gate widths.

11. A light-emitting device according to claim 6, wherein the first and the second thin film transistors have a same conductivity type.

12. A light-emitting device according to claim 6, wherein each of the first and second thin film transistors is an N-type thin film transistor, and a pixel electrode corresponds to an anode of a light-emitting element.

13. A light-emitting device according to claim 6, wherein each of the first and second thin film transistors has a semi-amorphous semiconductor film.

14. A light-emitting device according to claim 6, wherein each of the first and second thin film transistors has an amorphous semiconductor film.

15. A light-emitting device according to claim 6, wherein each of the first and second thin film transistors is formed by using an ink-jet process.

16. A light-emitting device according to claim 6, wherein the storage means comprises a capacitor.

17. A light-emitting device according to claim 6, wherein the light-emitting device is incorporated in at least one selected from the group consisting of a television, a video camera, a digital camera, a head mounted display, a game machine, a navigation system, a personal computer, an image reproducing apparatus, and a mobile phone.

18. An electronic equipment comprising:

a display portion as a display medium comprising a pixel, a source signal line, a gate signal line, and a power source line, the pixel comprising:

a first switch of which one terminal is connected to the source signal line, and another terminal is connected to a current-voltage conversion element;

a second switch of which one terminal is connected to the current-voltage conversion element, and another terminal is connected to a storage means and a voltage-current conversion element;

a pixel electrode which is connected to the current-voltage conversion element and the voltage-current conversion element;

a third switch of which one terminal is connected to the pixel electrode, and another terminal is connected to the power source line; and a light-emitting element of which one electrode comprises the pixel electrode.

19. An electronic equipment according to claim 18, wherein the first switch, the second switch and the third switch are controlled by the gate signal line.

20. An electronic equipment according to claim 18, wherein the first switch and the second switch are controlled by different gate signal lines.

21. A light-emitting device according to claim 18, wherein the storage means comprises a capacitor.

22. An electronic equipment according to claim 18, wherein the electronic equipment is at least one selected from the group consisting of a television, a video camera, a digital camera, a head mounted display, a game machine, a navigation system, a personal computer, an image reproducing apparatus, and a mobile phone.

23. An electronic equipment comprising:

a display portion as a display medium comprising a pixel, a source signal line, a gate signal line, and a power source line, the pixel comprising:

a first switch of which one terminal is connected to the source signal line, and another terminal is connected to a drain terminal of a first thin film transistor;

a second switch of which one terminal is connected to the drain terminal of the first thin film transistor, and another terminal is connected to a gate terminal of the first thin film transistor, a storage means and a gate terminal of a second thin film transistor;

a pixel electrode which is connected to a source terminal of the first thin film transistor and a source terminal of the second thin film transistor;

a third switch of which one terminal is connected to the pixel electrode, and another terminal is connected to the power source line; and a light-emitting element of which one electrode comprises the pixel electrode.

24. An electronic equipment according to claim 23, wherein the source terminal of the first thin film transistor and the source terminal of the second thin film transistor are connected to a pixel electrode through a resistor.

25. An electronic equipment according to claim 23, wherein the first switch, the second switch and the third switch are controlled by the gate signal line.

26. An electronic equipment according to claim 23, wherein the first switch and the second switch are controlled by different gate signal lines.

27. An electronic equipment according to claim 23, wherein the first thin film transistor and the second thin film transistor have different gate widths.

28. An electronic equipment according to claim 23, wherein the first and the second thin film transistors have a same conductivity type.

29. An electronic equipment according to claim 23, wherein each of the first and second thin film transistors is an N-type thin film transistor, and a pixel electrode corresponds to an anode of a light-emitting element.

30. An electronic equipment according to claim 23, wherein each of the first and second thin film transistors has a semi-amorphous semiconductor film.

31. An electronic equipment according to claim 23, wherein each of the first and second thin film transistors has an amorphous semiconductor film.

32. An electronic equipment according to claim 23, wherein each of the first and second thin film transistors is formed by using an ink-jet process.

33. A light-emitting device according to claim 23, wherein the storage means comprises a capacitor.

34. An electronic equipment according to claim 23, wherein the electronic equipment is at least one selected from the group consisting of a television, a video camera, a digital camera, a head mounted display, a game machine, a navigation system, a personal computer, an image reproducing apparatus, and a mobile phone.

* * * * *